US012392589B2

(12) United States Patent
Gensler

(10) Patent No.: US 12,392,589 B2
(45) Date of Patent: Aug. 19, 2025

(54) CARTRIDGE CASE CRIMPING TOOL

(71) Applicant: BAE Systems Information and Electronic Systems Integration Inc., Nashua, NH (US)

(72) Inventor: Jeffrey A. Gensler, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 110 days.

(21) Appl. No.: 18/455,823

(22) Filed: Aug. 25, 2023

(65) Prior Publication Data

US 2025/0067546 A1 Feb. 27, 2025

(51) Int. Cl.
*F42B 33/12* (2006.01)
*F42B 33/00* (2006.01)

(52) U.S. Cl.
CPC ..... *F42B 33/005* (2013.01)

(58) Field of Classification Search
None
See application file for complete search history.

(56) References Cited

U.S. PATENT DOCUMENTS 379,853 A * 3/1888 Brittin ..... F42B 33/12 86/39
413,435 A * 10/1889 Clifford ..... F42B 33/12 86/39
2,326,310 A * 8/1943 Johnson ..... F42B 3/24 102/314
2,719,453 A * 10/1955 Bahler ..... F42B 33/005 86/43
2,854,881 A * 10/1958 Craft ..... F42B 33/02 86/39
3,009,387 A * 11/1961 Puth ..... F42B 33/0292 86/29
3,036,489 A * 5/1962 Puth ..... F42B 33/12 86/39

(Continued)

FOREIGN PATENT DOCUMENTS

EP 3458797 7/2021
WO 2008000675 1/2008

(Continued)

*Primary Examiner* — Derrick R Morgan
(74) *Attorney, Agent, or Firm* — Sand, Sebolt & Wernow LPA; Gary McFaline

(57) ABSTRACT

A crimping tool for assembling a countermeasure expendable. The crimping tool includes a main body that has a top end, a bottom end vertically opposite to the top end, and an axis defined between the top end and the bottom end. The main body is configured to receive a cap of the countermeasure expendable, a spacer of the countermeasure expendable, and a cartridge case of the countermeasure expendable. The crimping tool also includes a presser that selectively operably engages with the main body and is configured to press the cap and the spacer of the countermeasure expendable into the cartridge case of the countermeasure expendable. The crimping tool also includes a set of crimpers that operably engages with the main body and is configured to crimp at least the cap, the spacer, the cartridge case with one another to collectively maintain the cap and the spacer with the cartridge case.

17 Claims, 16 Drawing Sheets

(56) References Cited

U.S. PATENT DOCUMENTS 3,048,077 A * 8/1962 Shelton ..... F42B 33/12 86/40
3,055,302 A * 9/1962 Eckstein ..... F42B 7/12 86/39
3,091,153 A * 5/1963 Roper ..... F42B 33/14 86/39
3,105,408 A * 10/1963 Bachhuber ..... F42B 33/004 86/39
3,196,736 A * 7/1965 Pace ..... F42B 33/12 86/39
3,347,128 A * 10/1967 Bachhuber ..... F42B 33/12 86/39
3,440,923 A * 4/1969 Purdie ..... F42B 33/10 86/43
3,580,127 A * 5/1971 Lee ..... F42B 33/10 86/24
4,048,899 A * 9/1977 Bachhuber ..... F42B 33/12 86/39
4,065,997 A * 1/1978 Allen ..... F42B 33/10 86/39
4,162,645 A * 7/1979 Abbott ..... F42B 7/12 86/39
4,836,078 A * 6/1989 Lee ..... F42B 33/04 86/39
6,397,718 B2 * 6/2002 Jamison ..... B23B 29/248 86/24
7,703,369 B1 * 4/2010 Lee ..... F42B 33/10 86/43
10,655,944 B1 * 5/2020 Gent ..... F42B 33/002
2005/0034592 A1 * 2/2005 Beal ..... F42B 12/74 86/29
2012/0210855 A1 8/2012 Clark et al.
2013/0180392 A1 * 7/2013 Nuetzman ..... F42B 33/00 86/19.5
2021/0376832 A1 12/2021 Branch et al.
2023/0031637 A1 2/2023 Milliorn, Jr. et al.
2024/0263929 A1 * 8/2024 Reed ..... F42B 33/005
2024/0263930 A1 * 8/2024 Reed ..... F42B 33/005

FOREIGN PATENT DOCUMENTS

WO 2011141724 11/2011
WO 2015075411 5/2015
WO WO-2015075411 A1 * 5/2015 ..... F42B 12/70
WO 2022261291 12/2022
WO 2023075772 5/2023

* cited by examiner

CARTRIDGE CASE CRIMPING TOOL

STATEMENT OF GOVERNMENT INTEREST

This invention was made with government support under Contract Number 14 D 0423/21 F 0005 awarded by a classified federal agency. The government has certain rights in the invention.

TECHNICAL FIELD

This disclosure is directed to a tool for assembling a countermeasure expendable.

BACKGROUND ART

In current military technologies, military platforms, such as a military aircraft, may include at least one countermeasure dispensing system (CMDS). The CMDS may eject one or more countermeasure expendables from the platform to dispense chaff material or flares away from the platform to counter a detected incoming threat, such as missiles or similar ballistic threats. Such dispensing of chaff material or flares away from the platform may then redirect the incoming threat away from the platform to leave the platform unscathed and/or unharmed. However, during flight, these countermeasure expendables must remain sealed while being able to release chaff material or flares when detonated on command during military operations.

To combat these issues, assemblers or machines have been used to assemble and seal these countermeasure expendables while still allowing the countermeasure expendables to release chaff material or flares on command during military operations. However, these machines require vast amounts of complex mechanical assemblies and parts in order to assemble each countermeasure expendable currently used by military platforms. Such complexity may require users of these machines to have extensive training and knowledge of these machines in order to run and operate these machines for assembling countermeasure expendables. Such complexity of these machines may also create extensive repairs and constant maintenance as these machines assembly vast amounts of countermeasure expendables in a given operation period.

SUMMARY OF THE INVENTION

In one aspect, an exemplary embodiment of the present disclosure may provide a crimping tool for a countermeasure expendable. The crimping tool includes of a main body having a top end, a bottom end vertically opposite to the top end, and an axis defined between the top end and the bottom end, wherein the main body is configured to house a cap of the countermeasure expendable, a spacer of the countermeasure expendable, and a portion of a cartridge case of the countermeasure expendable between the top end and the bottom end. The crimping tool also includes a presser that is selectively operably engages with the main body and is configured to press the cap and the spacer of the countermeasure expendable into the cartridge case of the countermeasure expendable. The crimping tool also includes a set of crimpers that operably engages with the main body and is configured to crimp at least the cap, the spacer, and the cartridge case with one another to collectively maintain the cap and the spacer with the cartridge case.

This exemplary embodiment or another exemplary embodiment may further include that the main body comprises: a central passageway defined between the top end of the main body and the bottom end of the main body; and a set of outer passageways defined between the top end of the main body and the bottom end of the main body and is in fluid communication with the central passageway; wherein the presser is selectively operably engaged with the main body at the central passageway and the cap of the countermeasure expendable, the spacer of the countermeasure expendable, and the portion of the cartridge case of the countermeasure expendable is housed in the central passageway; wherein each crimper of the set of crimpers is operably engaged with the main body inside a respective outer passageway of the set of outer passageways. This exemplary embodiment or another exemplary embodiment may further include that the presser comprises: a base selectively operably engaged with the main body; a stop moveably engaged with the main body and spaced apart from the base; and a biaser operably engaged with the base and the stop and configured to bias the stop away from the base. This exemplary embodiment or another exemplary embodiment may further include that the main body comprises: a first interior wall extending from the top end of the main body and towards the bottom end wherein the main body comprises and defining an upper central passage; wherein the base of the presser is configured to selectively operably engage with the first interior wall. This exemplary embodiment or another exemplary embodiment may further include that the main body further comprises: a shoulder extending outwardly from the first interior wall and into the upper central passage; wherein a first portion of the stop is configured to rest on the shoulder of the main body. This exemplary embodiment or another exemplary embodiment may further include that the main body further comprises: a second interior wall extending from the shoulder to the bottom end of the main body and defining a lower central passage that is in fluid communication with the upper central passage; wherein the main body is configured to receive and house the cap of the countermeasure expendable, the spacer of the countermeasure expendable, and the portion of the cartridge case of the countermeasure expendable inside of the lower central passage. This exemplary embodiment or another exemplary embodiment may further include that the main body further comprises: a shelf extending inwardly into the second interior wall and positioned below the shoulder; wherein a second portion of the stop is configured to rest on the shelf of the main body. This exemplary embodiment or another exemplary embodiment may further include that each crimper of the set of crimpers comprises: a first end, a second end opposite to the first end, and a longitudinal axis defined therebetween; a blanked portion extending from the first end towards the second end; a crimping portion extending from the blanked portion towards the second end and in fluid communication with the central passageway; and a threaded portion extending from the crimping portion to the second end. This exemplary embodiment or another exemplary embodiment may further include that each crimper of the set of crimpers further comprises: a first end of the crimping portion positioned proximate to the blanked portion; a second end of the crimping portion positioned proximate to the threaded portion and opposite to the first end; and a wall extending between the first end and the second end; wherein at least the wall is configured to crimp at least the cap, the spacer, the cartridge case with one another to collectively maintain the cap and the spacer with the cartridge case. This exemplary embodiment or another exemplary embodiment may further include that each crimper of the set of crimpers further comprises: an angle defining the wall measured relative to the longitudinal axis; wherein the angle is an acute angle. This exemplary embodiment or another exemplary embodiment may further include that the main body further comprises: a set of first inner walls wherein each first inner wall of the set of first inner walls extends from the top end of the main body to a respective first base wall of a set of first base walls that is positioned between the top end of the main body and the bottom end of the main body; and a set of second inner walls wherein each second inner wall of the set of second inner walls extends from a respective first base wall of the set of first base walls to the bottom end of the main body; wherein each first inner wall of the set of first inner walls and each first base wall of the set of first base walls defines a first portion of a respective outer passageway of the set of outer passageways; wherein each second inner wall of the set of second inner walls defines a second portion of a respective outer passageway of the set of outer passageways. This exemplary embodiment or another exemplary embodiment may further include that the main body further comprises: a through-hole defined in a first inner wall of the set of first inner walls and in a first base wall of the set of first base walls of each outer passageway of the set of outer passageways; wherein the crimping portion of a respective crimper of the set of crimpers is positioned inside of the through-hole and in fluid communication with the central passageway. This exemplary embodiment or another exemplary embodiment may further include that the main body further comprises: at least one viewing aperture defined in a front end of the main body that is positioned between the top end and the bottom end; wherein the at least one viewing aperture is in fluid communication with the central passageway and at least one outer passageway of the set of outer passageways.

In another aspect, an exemplary embodiment of the present disclosure may provide a method of assembling a countermeasure expendable with a crimping tool. The method comprises steps of: inserting a cap of the countermeasure expendable, a spacer of the countermeasure expendable, and a portion of a cartridge case of the countermeasure expendable into a central passageway of a main body of a crimping tool; pressing the cap of the countermeasure expendable and the spacer of the countermeasure expendable into the cartridge case of the countermeasure expendable by a presser of the crimping tool; crimping at least the cap, the spacer, the cartridge case with one another to collectively maintain the cap and the spacer with the cartridge case by a set of crimpers; and assembling the countermeasure expendable with the crimping tool.

This exemplary embodiment or another exemplary embodiment may further include a step of determining the at least the cap, the spacer, the cartridge case are crimped with one another, by at least one viewing aperture defined in the main body, when the cap, the spacer, the cartridge case are provided inside of the main body. This exemplary embodiment or another exemplary embodiment may further include steps of engaging the main body of the crimping tool with an external pressing tool at a first position; engaging the cartridge case of the countermeasure expendable with an external pressing tool at a second position opposite to the first position; and applying an external force on the crimping tool and the countermeasure expendable by the external pressing tool. This exemplary embodiment or another exemplary embodiment may further include a step of adjusting a base of the presser to a desired height inside of the central passageway of the main body; wherein the base is adjusted along an axis defined between a top end of the main body and a bottom end of the main body. This exemplary embodiment or another exemplary embodiment may further include a step of exerting biasing forces on a stop of the presser and the base of the presser in opposing direction by a biaser of the presser. This exemplary embodiment or another exemplary embodiment may further include a step of pressing the stop of the presser against one or both of a shoulder of the main body and a shelf of the main body inside of the central passageway. This exemplary embodiment or another exemplary embodiment may further include steps of compressing the biaser of the presser from an expanded position to a compressed position by the external pressing tool; disengaging the stop of the presser from one or both of the shoulder of the main body and the shelf of the main body inside of the central passageway; and moving the stop of the presser along the axis of the main body defined between the top end of the main body and the bottom end of the main body when the cap of the countermeasure expendable and the spacer of the countermeasure expendable are pressed into the cartridge case of the countermeasure expendable. This exemplary embodiment or another exemplary embodiment may further include a step of engaging the set of crimpers with the main body inside a set of outer passageways; and wherein the set of outer passageways is in fluid communication with the central passageway.

In yet another exemplary embodiment, an exemplary embodiment of the present disclosure may provide a crimping tool for a countermeasure expendable. The crimping tool comprises a main body that has a top end, a bottom end opposite to the top end, and an axis defined between the top end and the bottom end, wherein the main body is configured to receive a cap, a spacer, and a portion of a cartridge case. The crimping tool also comprises a presser that is selectively operably engaged with the main body and is configured to press the cap and the spacer of the countermeasure expendable into the cartridge case of the countermeasure expendable. The presser further comprises a base that is selectively operably engaged with the main body, a stop that is moveably engaged with the main body and is spaced apart from the base, and a biaser that is operably engaged with the base and the stop and is configured to bias the stop away from the base. The crimping tool also comprises a set of crimpers that operably engaged with the main body and is configured to crimp at least the cap, the spacer, and the cartridge case with one another to collectively maintain the cap and the spacer with the cartridge case and to seal the countermeasure expendable.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

FIGS. 1-7 illustrated a cartridge case crimping tool (hereinafter "crimping tool") generally referred to as 1. As discussed in greater detail below, crimping tool 1 is configured to assemble a cap of a countermeasure expendable, a spacer or gasket of the countermeasure expendable, and a canister or cartridge case of the countermeasure expendable with one another. Such crimping tool 1 may be used with an external pressing tool that is configured to provide an external pressing force on the crimping tool 1 and the countermeasure expendable to press and crimp fit the cap of the countermeasure expendable, the spacer of the countermeasure expendable, and the cartridge case of the countermeasure expendable with one another at a desired pressure. Such components and elements of crimping tool 1 are discussed in greater detail below.

Figure 1:
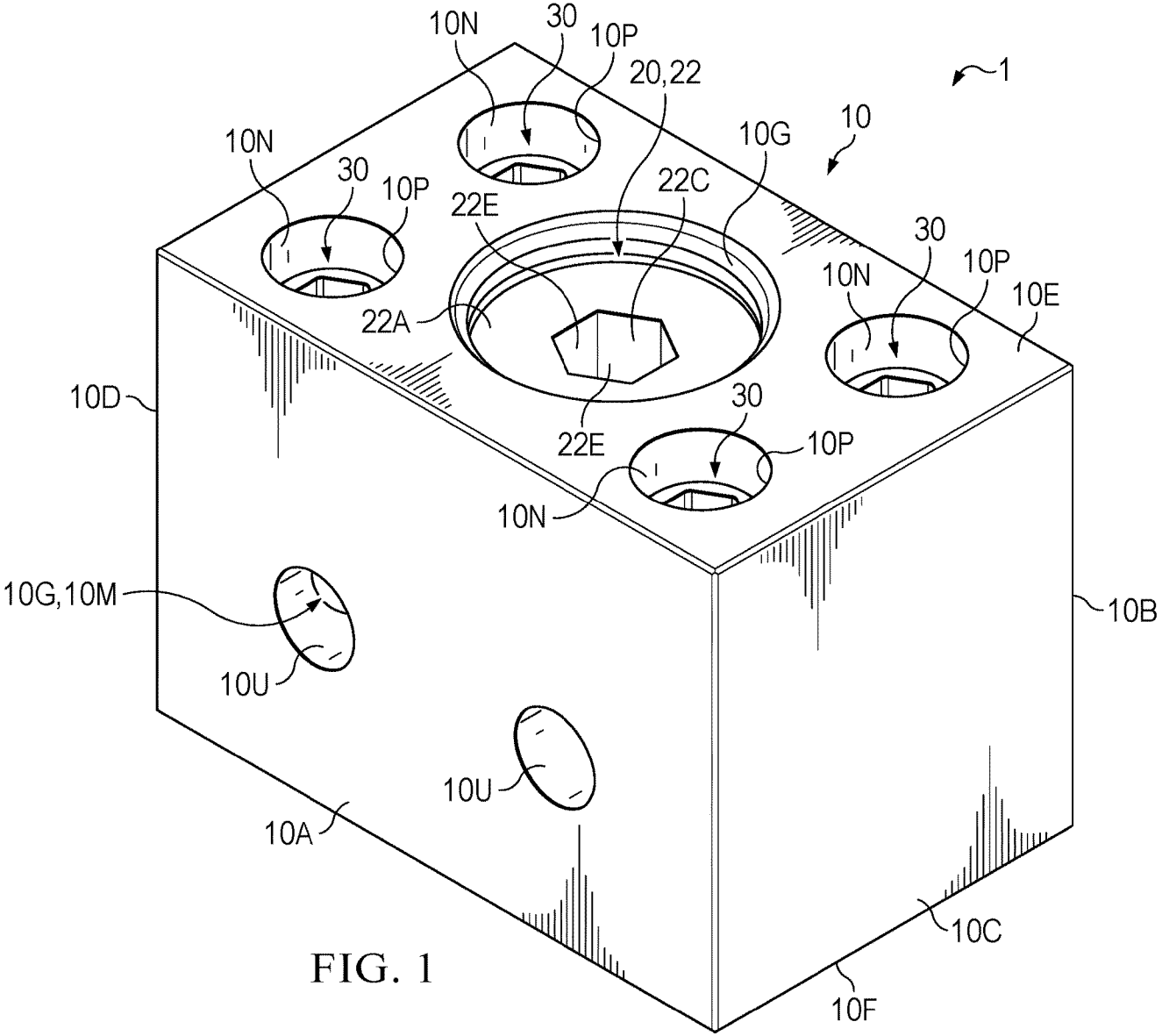
FIG. 1 (FIG. 1) is a front, top, first side isometric perspective view of a crimping tool in accordance with one aspect of the present disclosure.

Crimping tool 1 includes a main body 10. As best seen in FIG. 1, main body 10 includes a front end 10A, a rear end 10B opposite to the front end 10A, and a first axis defined therebetween. Main body 10 also includes a first side 10C that extends between the front end 10A and the rear end 10B, a second side 10D that extends between the front end 10A and the rear end 10B and is opposite to the first side 10C, and a second axis defined therebetween. Main body 10 also includes a top end 10E that is positioned above the front end 10A, the rear end 10B, the first side 10C, and the second side 10D, a bottom end 10F that is positioned below the front end 10A, the rear end 10B, the first side 10C, and the second side 10D and opposite to the top end 10E, and a third axis defined therebetween.

Figure 7:
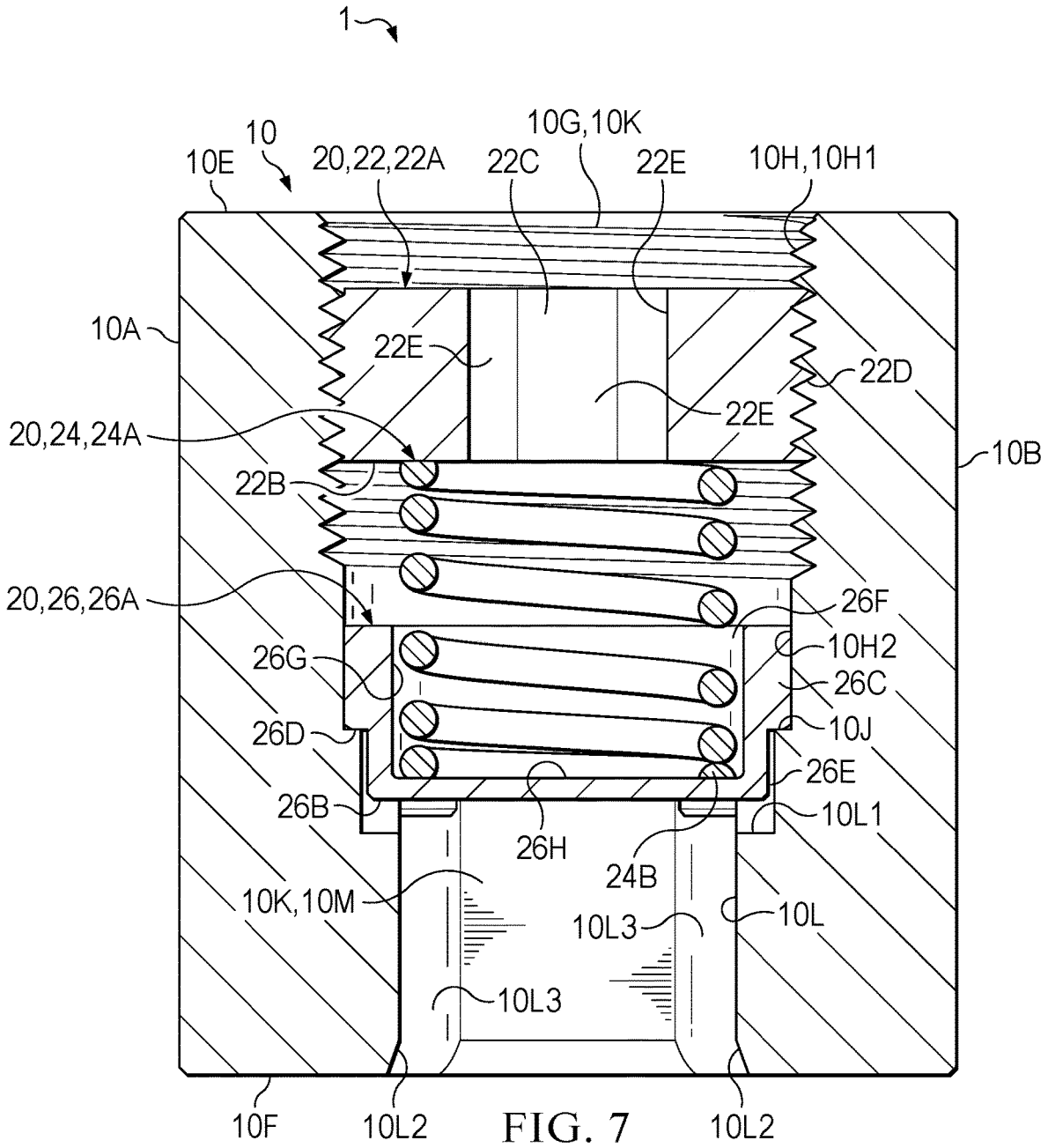
FIG. 7 (FIG. 7) is a cross-sectional view of the crimping tool taken in the direction of line 7-7 shown in FIG. 3.

Main body 10 also defines a central passageway 10G. As best seen in FIG. 7, central passageway 10G extends entirely through the main body 10 between the top end 10E and the bottom end 10F parallel to the third axis wherein the top end 10E and the bottom end 10F are in fluid communication with one another. As discussed in greater detail below, various structural elements of main body 10 define central passageway 10G.

Main body 10 also includes a first interior wall 10H. As best seen in FIG. 7, first interior wall 10H extends downwardly along the third axis from the top end 10E toward the bottom end 10F to a shoulder 10J. In the present disclosure, the first interior wall 10H defines a first or upper central passage 10K that makes up a portion of the central passageway 10G. First interior wall 10H also defines internal threads 10H1 that extend outwardly from the first interior wall 10H and into the upper central passage 10K. Internal threads 10H1 are also defined along a first portion of the first interior wall 10H between the top end 10E of the main body 10 to a blanked portion 10H2 of first interior wall 10H. Referring to blanked portion 10H2, blanked portion 10H2 extends downwardly from the internal threads 10H1 to the shoulder 10J. Such use and purpose of the first interior wall 10H is discussed in greater detail below.

Main body 10 also includes a second interior wall 10L. As best seen in FIG. 7, second interior wall 10L extends downwardly along the third axis from the shoulder 10J to the bottom end 10F of main body 10. In the present disclosure, the second interior wall 10L defines a second or lower central passage 10M that makes up another portion of the central passageway 10G. Second interior wall 10L also defines a ledge or shelf 10L1 that extends into the second interior wall 10L and away from the lower central passage 10M. As best seen in FIG. 7, the shelf 10L1 is defined directly below the shoulder 10J in the second interior wall 10L; such use and purpose of shelf 10L1 is discussed in greater detail below. Second interior wall 10L also defines chamfer 10L2 that extends upwardly from the bottom end 10F of main body 10 towards the shoulder 10J. As discussed in greater detail below, the chamfer 10L2 provides a larger opening at the bottom end 10F of main body 10 to prevent a user or assembler from having to exactly align a cap of a countermeasure expendable, a spacer of the countermeasure expendable, and a cartridge case of the countermeasure expendable with the main body 10 prior to insertion. In other exemplary embodiments, chamfer 10L2 defined in the second interior wall 10L may also be defined in the second interior wall 10L as as a flared edge, a tapered edge, a beveled edge, or an angled edge that extends upwardly from the bottom end 10F of main body 10 towards the shoulder 10J Still referring to second interior wall 10L, second interior wall 10L also defines a set of grooves 10L3. As best seen FIGS. 4-8D, each groove of the set of grooves 10L3 extends along the length of the second interior wall 10L from the bottom end 10F to the shoulder 10J. In the present disclosure, each groove of the set of grooves 10L3 also extends parallel to the third axis. As discussed in greater detail below, the set of grooves 10L3 may enable ease of inserting a countermeasure expendable prior to being crimped and assembled and ease of removing the countermeasure expendable once crimped and assembled. As such, corners of a cap of a countermeasure expendable, a spacer of the countermeasure expendable, and a cartridge case of the countermeasure expendable may ride inside and/or along the main body 10 inside of the set of grooves 10L3 prior to the countermeasure expendable being crimped and assembled.

Figure 6:
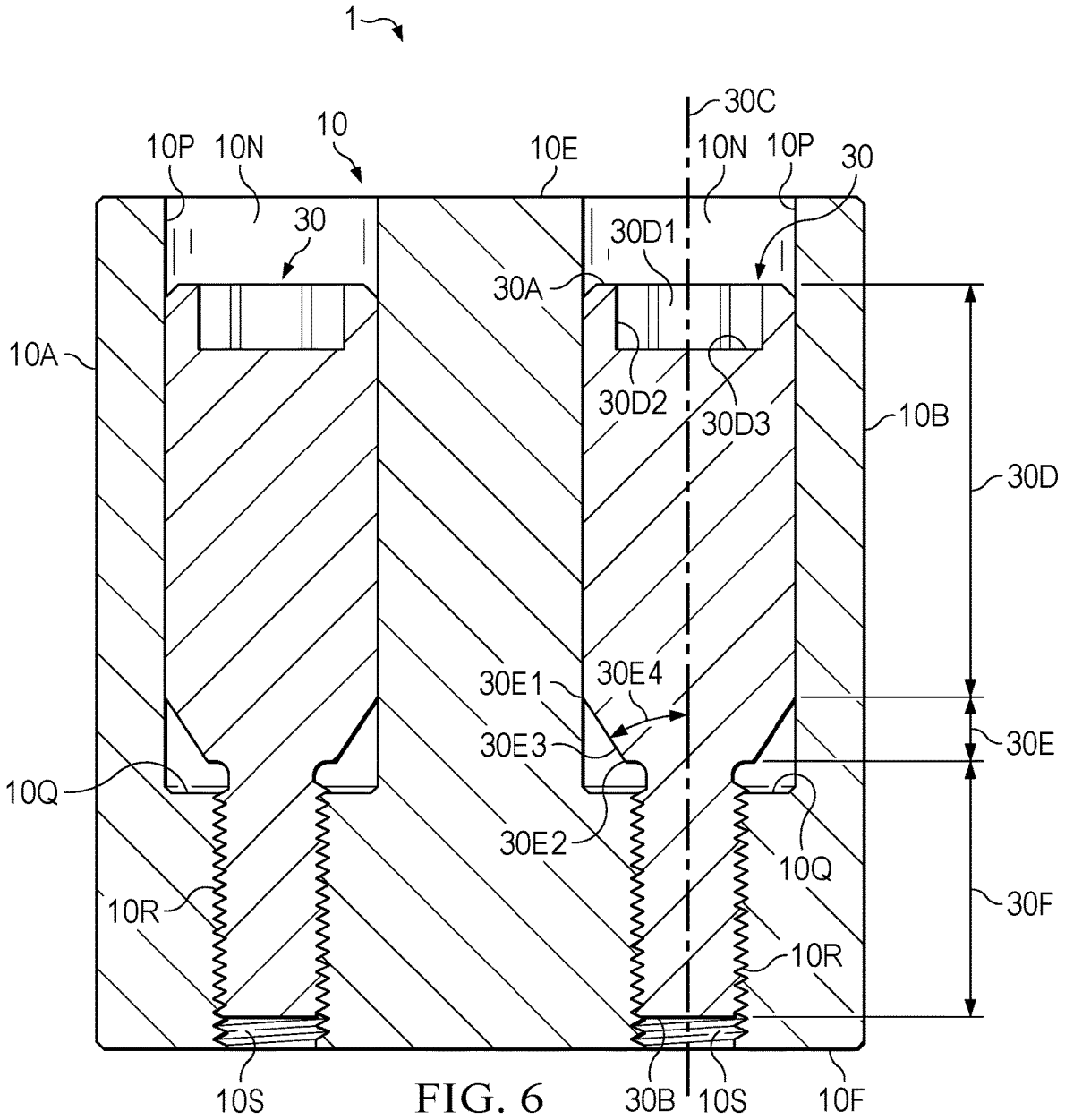
FIG. 6 (FIG. 6) is a cross-sectional view of the crimping tool taken in the direction of line 6-6 shown in FIG. 3.

Main body 10 also defines a set of outer passageways 10N that surrounds the central passageway 10G and is in fluid communication with the central passageway 10G. The term "outer" refers to passageways 10N being eccentric to central passageway 10G, but sill defined within the main body 10. As best seen in FIG. 6, each outer passageway of the set of outer passageways 10N is defined by an inner wall 10P of a set of first inner walls 10P that extends downwardly from the top end 10E of the main body 10 to a respective base wall 10Q of a set of base walls 10Q. Still referring to FIG. 6, each outer passageway of the set of outer passageways 10N is also defined by an inner wall of a set of second inner walls 10R that extends downwardly from a respective base wall of the set of base walls 10Q to the bottom end 10F of main body 10. Each inner wall of the set of second inner walls 10R also defines an inner thread 10S that extends outwardly from a respective inner wall of the set of second inner walls 10R and into a respective outer passageway of the set of outer passageways 10N; such use and purpose of the inner thread 10S of each inner wall of the set of second inner walls 10R is discussed in greater detail below.

Figure 8A:
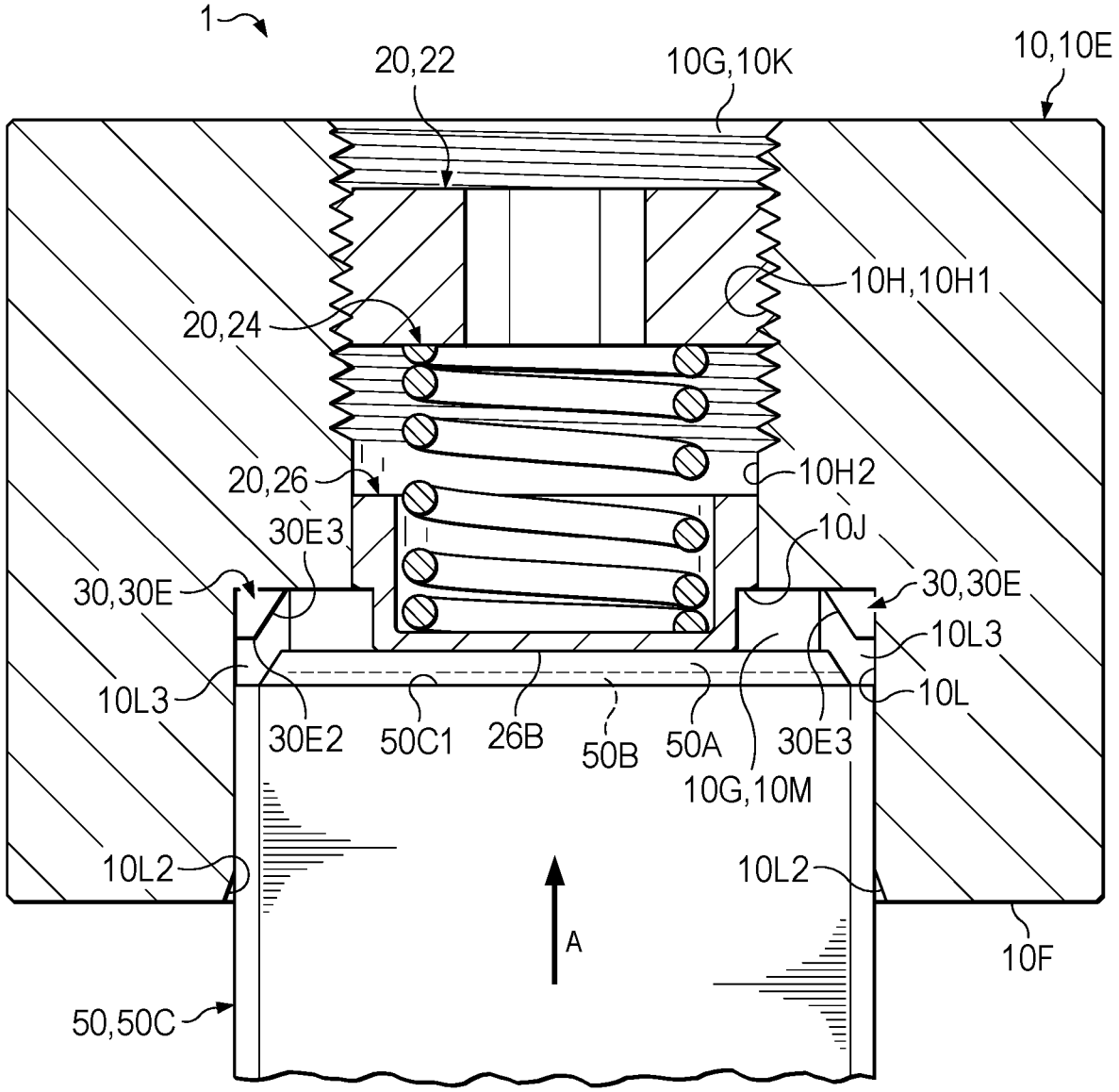
FIG. 8A (FIG. 8A) is an operational view of a cap, a spacer, and a portion of a cartridge case of a countermeasure expendable being loaded into the crimping tool.

Still referring to the set of outer passageways 10N, each inner wall of the set of first inner walls 10P and each base wall of the set of base walls 10Q also defines a through-hole 10T. As best seen in FIG. 8D, each through-hole 10T defined by each inner wall of the set of first inner walls 10P and each base wall of the set of base walls 10Q extends along an axis that is orthogonal to the third axis of crimping tool 1 (see FIG. 8D). In the present disclosure, each through-hole 10T defined by each inner wall of the set of first inner walls 10P and each base wall of the set of base walls 10Q provides fluid communication between the central passageway 10G and the set of outer passageways 10N for enabling crimping actions by crimping tool 1, which are discussed in greater detail below.

In one particular embodiment, there are four outer passageways 10N, wherein each of the four outer passageways 10N are located adjacent the four respective corners of the main body 10, when the main body 10 is a rectangular cube or rectangular cuboid. However, a different number of outer passageways 10N are possible depending on the configuration of the main body 10. For example, instead of being formed as a rectangular cube, the main body could be configured as a tetrahedron, octahedron, dodecahedron, icosahedron, prism or anti-prism.

Figure 2:
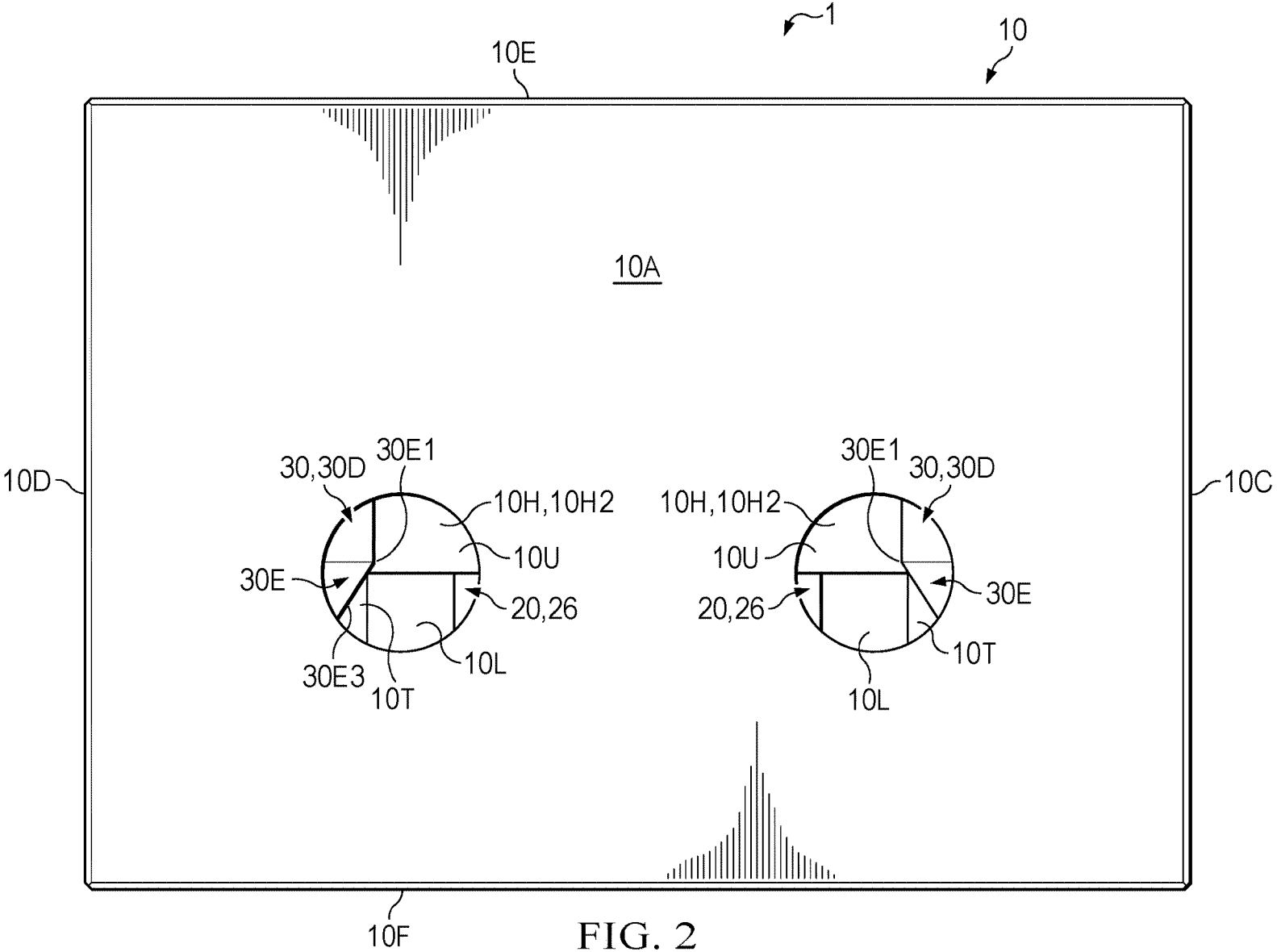
FIG. 2 (FIG. 2) is a front elevation view of the crimping tool.
Figure 3:
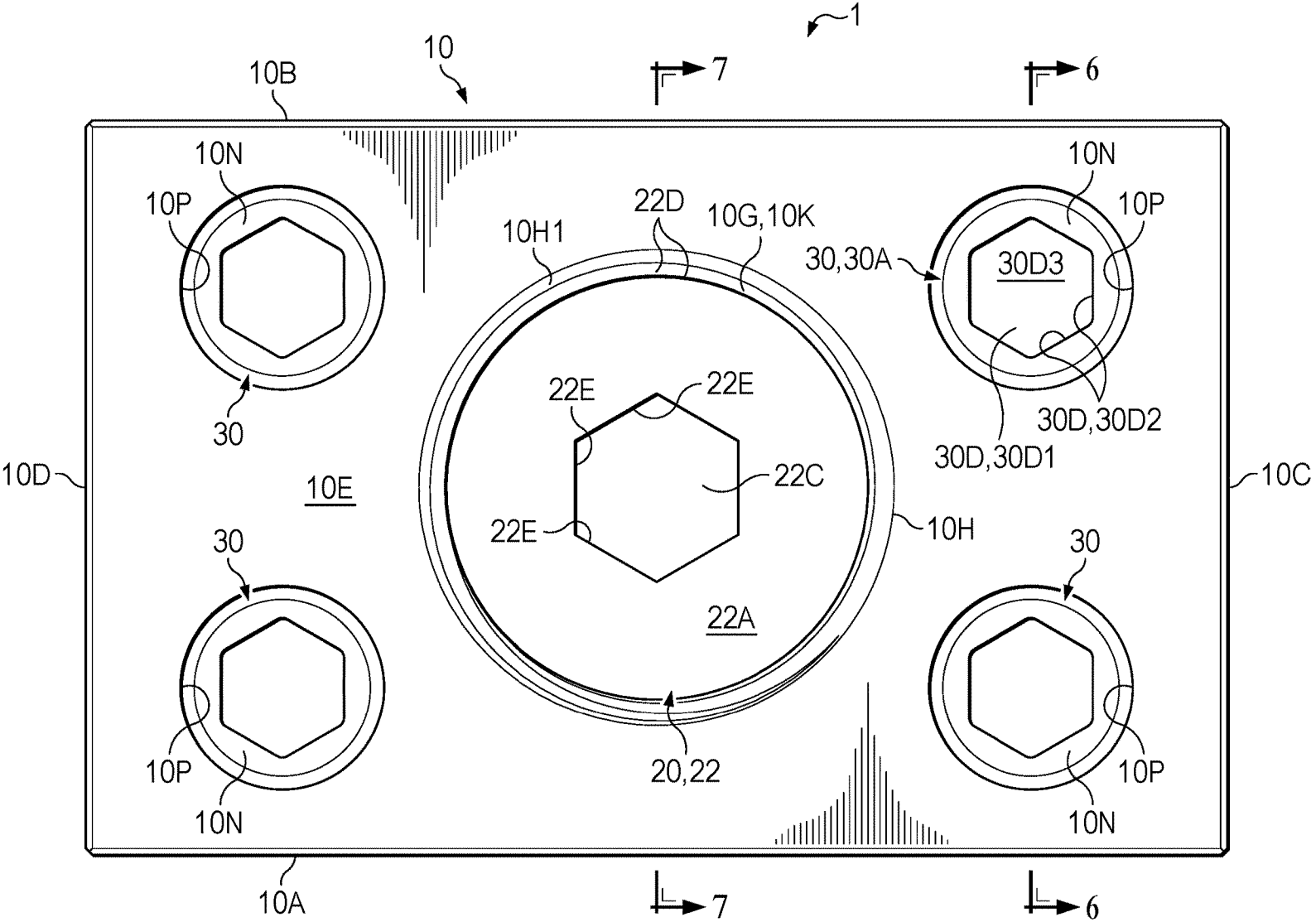
FIG. 3 (FIG. 3) is a top plan view of the crimping tool.
Figure 4:
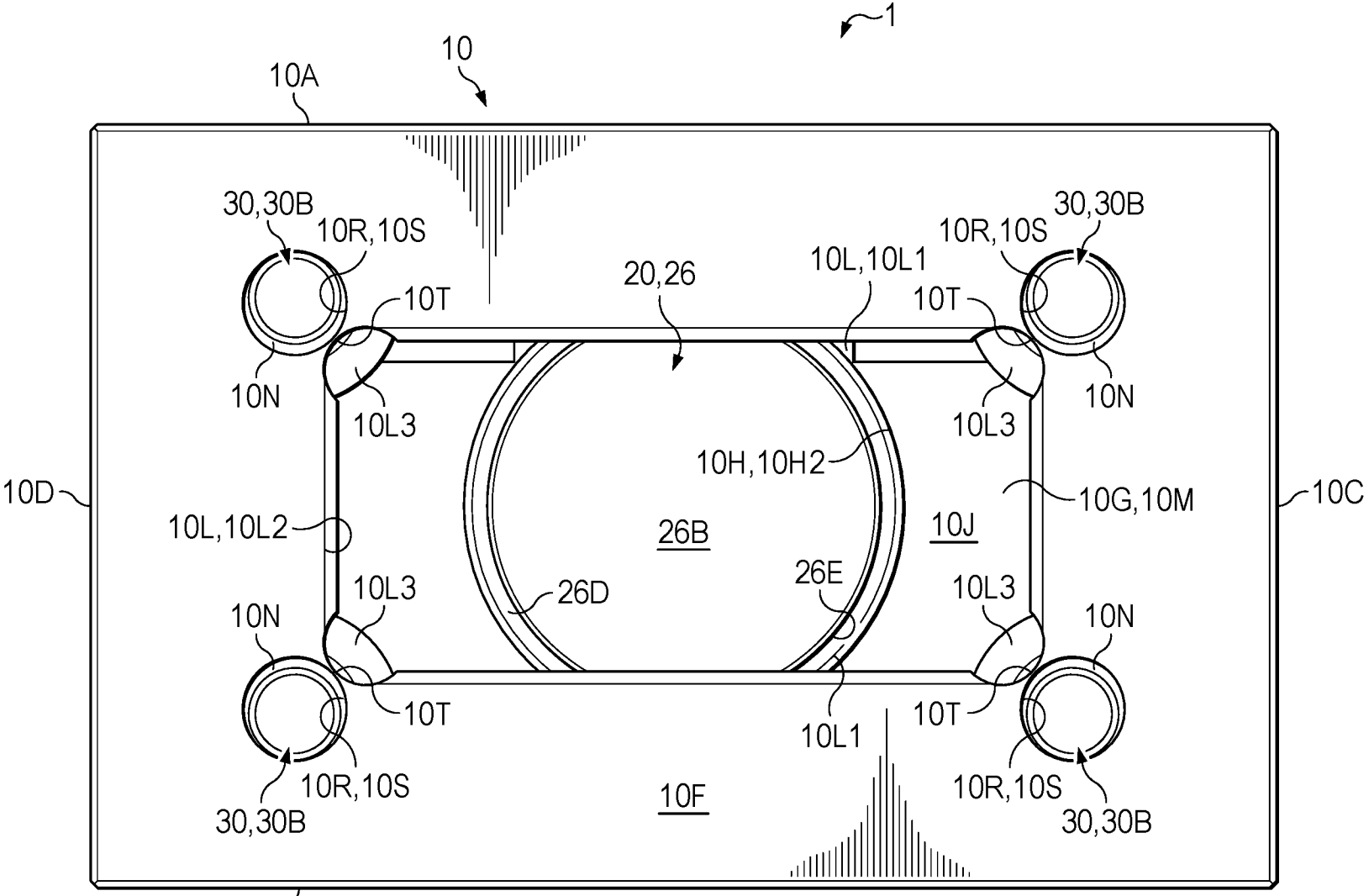
FIG. 4 (FIG. 4) is bottom plan view of the crimping tool.

Main body 10 also defines at least one viewing aperture 10U. As best seen in FIGS. 1-2, main body 10 defines a set of viewing apertures 10U that extends into the main body 10 from the front end 10A towards the rear end 10B and parallel to the first axis. In the present disclosure, each viewing aperture of the set of viewing apertures 10U is defined through the first interior wall 10H, the second interior wall 10L, at least two inner walls of the set of first inner walls 10P. With such structural configuration, each viewing aperture of the set of viewing apertures 10U is in fluid communications with the central passageway 10G (both the upper central passage 10K and the lower central passage 10M) and with at least two outer passageways of the set of outer passageways 10N. As discussed in greater detail below, the set of viewing apertures 10U enables a user or assembler countermeasure expendables to view a cap of a countermeasure expendable and a spacer of the countermeasure expendable being pressed into a cartridge case of the countermeasure expendable and being crimped with the cartridge case while operating the external pressing tool.

Crimping tool 1 also includes a presser 20 that operably engages with the main body 10 inside of central passageway 10G. In operation, the presser 20 is configured to be selectively operably engaged with the main body 10 to press-fit a cap of a countermeasure expendable and a spacer of the countermeasure expendable into a cartridge case of the countermeasure expendable to assemble the countermeasure expendable. Such components and elements of presser 20 are discussed in greater detail below.

Figure 5:
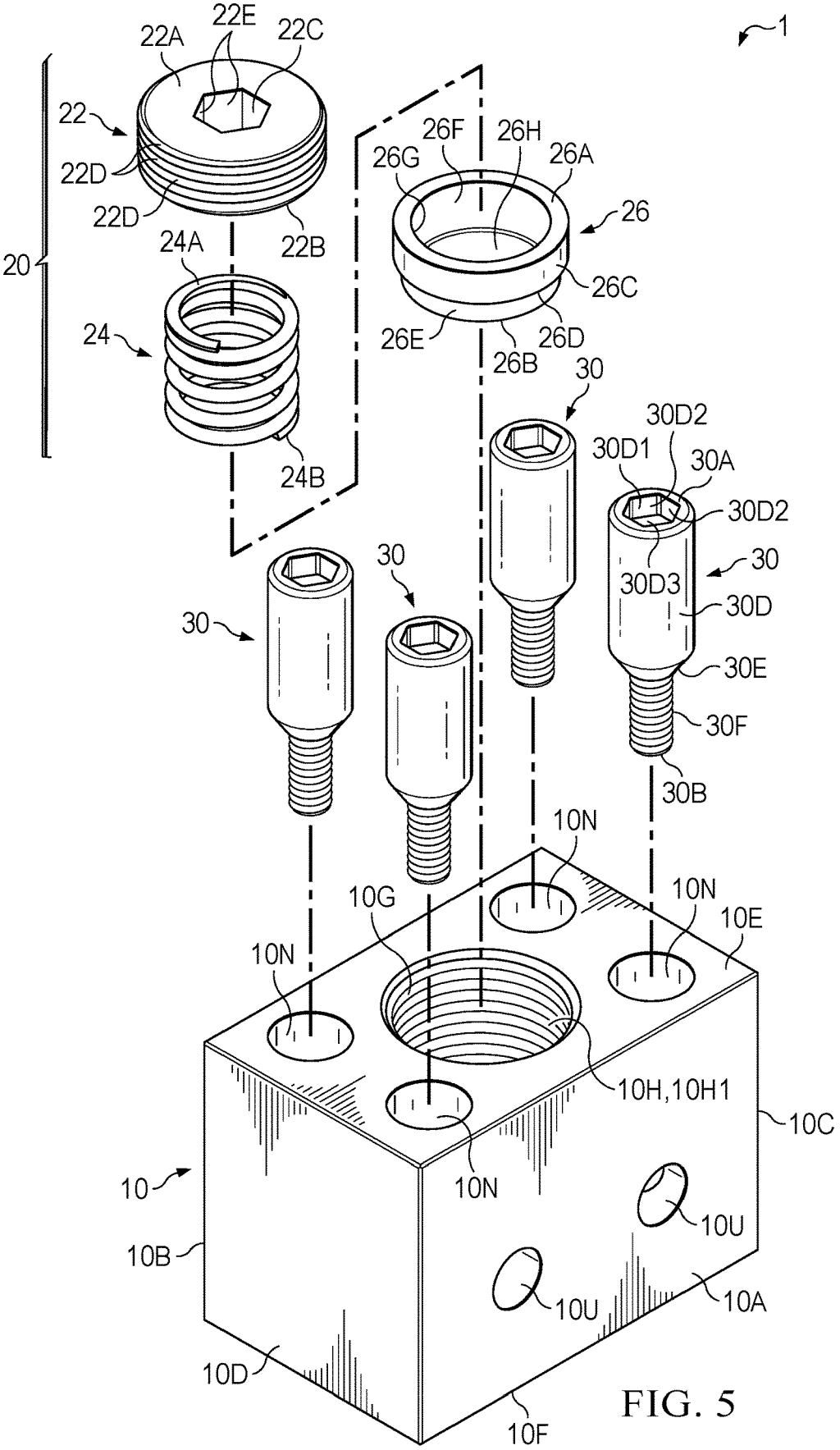
FIG. 5 (FIG. 5) is an exploded view of the crimping tool.

Presser 20 includes a base 22 that operably engages with the main body 10. As best seen in FIG. 5, base 22 includes a first end 22A, a second end 22B opposite to the first end 22A, and a hole 22C that extends entirely through the base 22 between the first end 22A and the second end 22B. It should be noted that the first end 22A and the second end 22B are also in fluid communication with one another at the hole 22C.

Base 22 also defines external threads 22D that extends outwardly from the base 22 and are positioned between the first end 22A and the second end 22B. The external threads 22D of base 22 are also complementary with the internal threads 10H1 of main body 10 to enable the base 22 to be threadably engaged with the main body 10 inside of central passageway 10G (see FIG. 7). It should be noted that the structural configuration between external threads 22D of base 22 and internal threads 10H1 of main body 10 prevents the base 22 from rotating upwardly and/or backing out of central passageway 10G when an upward force is applied against a stop of the presser 20 by a cap of a countermeasure expendable during assembly of said countermeasure expendable.

Base 22 also includes a plurality of angled walls or facets 22E. As best seen in FIGS. 5 and 7, the plurality of facets 22E internally extends through the base 22 between the first end 22A and the second end 22B and collectively define the hole 22C. In operation, a driving bit equipped to a driving tool may be inserted into hole 22C and operably engaged with the plurality of facets 22E by a user of crimping tool 1 to drive and/or screw base 22 into main body 10 at a desired and/or predetermined depth inside of main body 10.

Presser 20 also includes a biaser 24 that operably engages with the base 22. As best seen in FIG. 7, biaser 24 includes a first end 24A that operably engages with the second end 22B of base 22, a second end 24B spaced apart from the base 22 and opposite to the first end 24A, and a longitudinal direction defined between the first end 24A and the second end 24B. In operation, biaser 24 is configured to compress and/or move in the longitudinal direction between various longitudinal positions when an upward force is applied by a cap of a countermeasure expendable during assembly of said countermeasure expendable. As such, biaser 24 may take at least two forms wherein the biaser 24 is provided at a first or expanded position (see FIGS. 7 and 8B) when an upward force is absent and a second or compressed position (see FIGS. 8C-8D) when an upward force is applied by a cap of a countermeasure expendable during assembly of said countermeasure expendable.

Presser 20 also includes a stop 26 that operably engages with the biaser 24. In the present disclosure, stop 26 has a generally annular or ring-like configuration. As best seen in FIG. 5, stop 26 includes a first end 26A, second end 26B spaced opposite to the first end 26A, and a longitudinal axis defined between the first end 26A and the second end 26B. Stop 26 also includes a collar 26C that extends downwardly from the first end 26A to a shoulder 26D that is positioned between the first end 26A and the second end 26B. Stop also includes an outer wall 26E that extends from the shoulder 24D to the second end 22B. In the present disclosure, collar 26C defines an outer diameter that is greater than an outer diameter defined by the outer wall 26E. Such difference in outer diameters between the collar 26C and outer wall 26E enables the stop 26 to rest and/or engage with the shoulder 10J of main body 10 once the main body 10 and the presser 20 are assembled with one another. It should be understood that the second end 26B of the stop 26 may also rest and/or engaged with the shelf 10L1 of main body 10 once the main body 10 and the presser 20 are assembled with one another.

Still referring to stop 26, stop 26 also defines a recess 26F. As best seen in FIG. 7, recess 26F is collectively defined by an interior wall 26G of the stop 26 that extends from the first end 26A to a base wall 26H that is positioned between the first end 26A and the second end 26B. Upon assembly of crimping tool 1, the second end 24B of biaser 24 operably engages with at least the base wall 26H of stop 26 inside of recess 26F. As such, the base 22 and the stop 26 operably engage with one another by the biaser 24 yet are spaced apart from one another inside of main body 10.

To assemble the presser 20 with main body 10, the stop 26 is initially inserted into the main body 10 at the top end 10E and through the central passageway 10G. The stop 26 may rest on either one or both of the shoulder 10J and the shelf 10L1 inside of the central passageway 10G. Second, the biaser 24 is then inserted into the main body 10 at the top end 10E and through the central passageway 10G. Once inserted into the main body 10, the second end 24B of biaser 24 rests on the base wall 26H of stop 26 inside of the recess 26F of stop 26. Third, the base 22 is then operably engage with the first interior wall 10H of main body 10. Particularly, user may use a driving tool equipped with a driving bit to threadably engage and/or screw the base 22 with the main body 10. The user may continue to screw the base 22 into the main body 10 until a desired depth is met inside of main body 10 or until the first end 24A of the biaser 24 engages with the second end 22B of base 22 and the biaser 24 is loaded at a desired biasing force.

While the base 22, the biaser 24, and the stop 26 may be separate components prior to being installed with the main body 10, presser 20 may be assembled in various ways prior to be installed and/or engaged with the main body 10. In one instance, biaser 24 may be assembled with the base 22 (i.e., first end 24A of biaser 24 is connected with the second end 22B of base 22) prior to being engaged with the main body 10. In another instance, biaser 24 may be assembled with the stop 26 (i.e., second end 24B of biaser 24 is connected with the base wall 26H of stop 26) prior to being engaged with the main body 10. In yet another instance, biaser 24 may be assembled with the base 22 (i.e., first end 24A of biaser 24 is connected with the second end 22B of base 22) and the stop 26 (i.e., second end 24B of biaser 24 is connected with the base wall 26H of stop 26) prior to being engaged with the main body 10.

During operation, the stop 26 is configured to be maintained at a predetermined positioned inside of the central passageway 10G while the main body 10 and other associated parts of crimping tool 1 move downwardly when an upward force is applied to the second end 26B of stop 26 by a cap of a countermeasure expendable during assembly of said countermeasure expendable. In one particular embodiment, crimping tool 1 only moves vertically downward while the stop 26 remains at the predetermined position once the cap of the countermeasure expendable and the spacer of the countermeasure expendable are pressed into the cartridge case of the countermeasure expendable and exert a force that is greater than the biasing force exerted by the biaser 24. As such, the main body 10 and other associated parts of crimping tool 1 only move vertically downward once the assembled countermeasure expendable exerts a pushing force that is greater than the biasing force exerted by the biaser 24. However, other embodiments may provide for the movement of the crimping tool 1 based on other thresholds or force levels. Alternatively, the crimping tool 1 may remain stationary in a vice and the countermeasure expendable cartridge is moved in a linear manner into the crimping tool 1 while it remains stationary.

In the present disclosure, the biaser 24 applies a predetermined biasing force and/or tensile strength against the stop 26 to press-fit a cap of a countermeasure expendable and a spacer of the countermeasure expendable into a cartridge case of the countermeasure expendable. In one exemplary embodiment, the biaser 24 may apply a biasing force of approximately ten pounds of pressure (e.g., ten pounds per square inch) against the stop 26. In another exemplary embodiment, the biaser 24 may apply a biasing force of approximately fifty pounds of pressure (e.g., fifty pounds per square inch) against the stop 26. In another exemplary embodiment, the biaser 24 may apply a biasing force of approximately sixty pounds of pressure (e.g., sixty pounds per square inch) against the stop 26. The predetermined biasing force applied to the stop 26 by biaser 24 ensures that the cap of the countermeasure expendable remains flush or even with a top or open end of the cartridge case prior to being crimped with the cartridge case. The predetermined biasing force applied to the stop 26 by biaser 24 also ensures that compression load applied to the spacer of the countermeasure expendable is met to resist and/or prevent internal movement of a payload of the countermeasure expendable inside of the cartridge case of the countermeasure expendable.

Crimping tool 1 also includes a set of crimpers 30 that operably engages with the main body 10. As best seen in FIG. 5, each crimper of the set of crimpers 30 includes a first end 30A, a second end 30B that opposite to the first end 30A, and a longitudinal axis defined therebetween (denoted by a dashed line labeled 30C in FIG. 6).

Each crimper of the set of crimpers 30 also includes a blanked portion 30D that extends downwardly from the first end 30A towards the second end 30B along the longitudinal axis 30C. As best seen in FIGS. 5-6, the blanked portion 30D of each crimper of the set of crimpers 30 defines a recess 30D1 by a plurality of angled walls or facets 30D2 internally extending from the first end 30A to a base wall 30D3. In operation, a driving bit equipped to a driving tool may be inserted into recess 30D1 and operably engages with the plurality of facets 30D2 by a user of crimping tool 1 to drive and/or screw each crimper of the set of crimpers 30 into main body 10; such structural configurations enabling a user to drive and/or screw each crimper of the set of crimpers 30 into main body 10 are discussed in greater detail below.

Each crimper of the set of crimpers 30 also includes a crimping portion 30E that extends downwardly from blanked portion 30D towards the second end 30B. As best seen in FIG. 6, the crimping portion 30E of each crimper of the set of crimpers 30 includes a first end 30E1 that operably engaged with the blanked portion 30D, a second end 30E2 spaced apart from the blanked portion 30D and opposite to the first end 30E1, and an angled or beveled wall 30E3 that extends between the first end 30E1 and the second end 30E2. The angled wall 30E3 of the crimping portion 30E of each crimper of the set of crimpers 30 is also defined at angle 30E4 that is measured relative to the longitudinal axis 30C of each crimping portion 30E of each crimper of the set of crimpers 30. In one exemplary embodiment, the angle 30E4 defining the angled wall 30E3 of each crimping portion 30E of each crimper of the set of crimpers 30 is an acute angle.

Each crimper of the set of crimpers 30 also includes a threaded portion 30F that extends downwardly from crimping portion 30E to the second end 30B. In the present disclosure, the threaded portion 30F of each crimper of the set of crimpers 30 includes a threading that is complementary with the inner threads 10S of the main body 10 provided inside each outer passageway of the set of outer passageways 10N. Such complementary threading between the threaded portions of the set of crimpers 30 and the sets of inner threads 10S of the main body 10 enables the set of crimpers 30 to be threadably engaged with and/or screwed into the main body 10 by driving tool operated by the user.

Upon assembly of the main body 10 and the set of crimpers 30, a section of the crimping portion 30E of each crimper of the set of crimpers 30 is in fluid communications with the central passageway 10G. As best seen in FIG. 8D, a section of the crimping portion 30E of each crimper of the set of crimpers 30 is housed inside of a respective through-hole 10T of the main body 10 to enable the crimping portion 30E of each crimper of the set of crimpers 30 to crimp a cap, a spacer, and a cartridge case of a countermeasure expendable together at the angle 30E4 as the cap and the spacer of the countermeasure expendable are being pressed-fit into the cartridge case of the countermeasure expendable. Such operations of press-fitting and crimping of a cap, a spacer, and a cartridge case of a countermeasure expendable are discussed in greater detail below.

Having now described the components and elements of crimping tool 1, a method of assembling a cap, a spacer, and a cartridge case of a countermeasure expendable with one another by the crimping tool 1 and an external pressing tool is discussed in greater detail below.

Prior to press-fitting and crimping a countermeasure expendable 50, a user of the crimping tool 1 must first insert a cap 50A of the countermeasure expendable 50, a spacer 50B of the countermeasure expendable 50, and a cartridge case 50C of the countermeasure expendable 50 into the crimping tool 1. As best seen in FIG. 8A, the user may initially load the cap 50A into the central passageway 10G of main body 10 at the bottom end 10F and then followed by the spacer 50B and the cartridge case 50C; such insertion of the cap 50A, the spacer 50B, and the cartridge case 50C are denoted by an arrow labeled "A" in FIG. 8A. It should be understood that at least the cap 50A and the spacer 50B may be engaged with and partially housed inside of the cartridge case 50C prior to the cap 50A, the spacer 50B, and the cartridge case 50C being press-fitted and crimped together. Once inserted into the main body 10, the cap 50A contacts the second end 26B of stop 26 when the stop 26 of presser 20 is provided in a first position due to the biaser 24 being provided in the expanded position (see FIG. 8A). The cartridge case 50C may also be contacting the second interior wall 10L of main body 10 inside of the central passageway 10G (particularly inside of lower central passage 10M). The corners of cartridge case 50C may also be engaged with the second interior wall 10L inside of the set of grooves 10L3. A top or opening end 50C1 of the cartridge case 50C is also housed inside of the main body 10 and is positioned proximate to the set of crimpers 30.

Figure 8B:
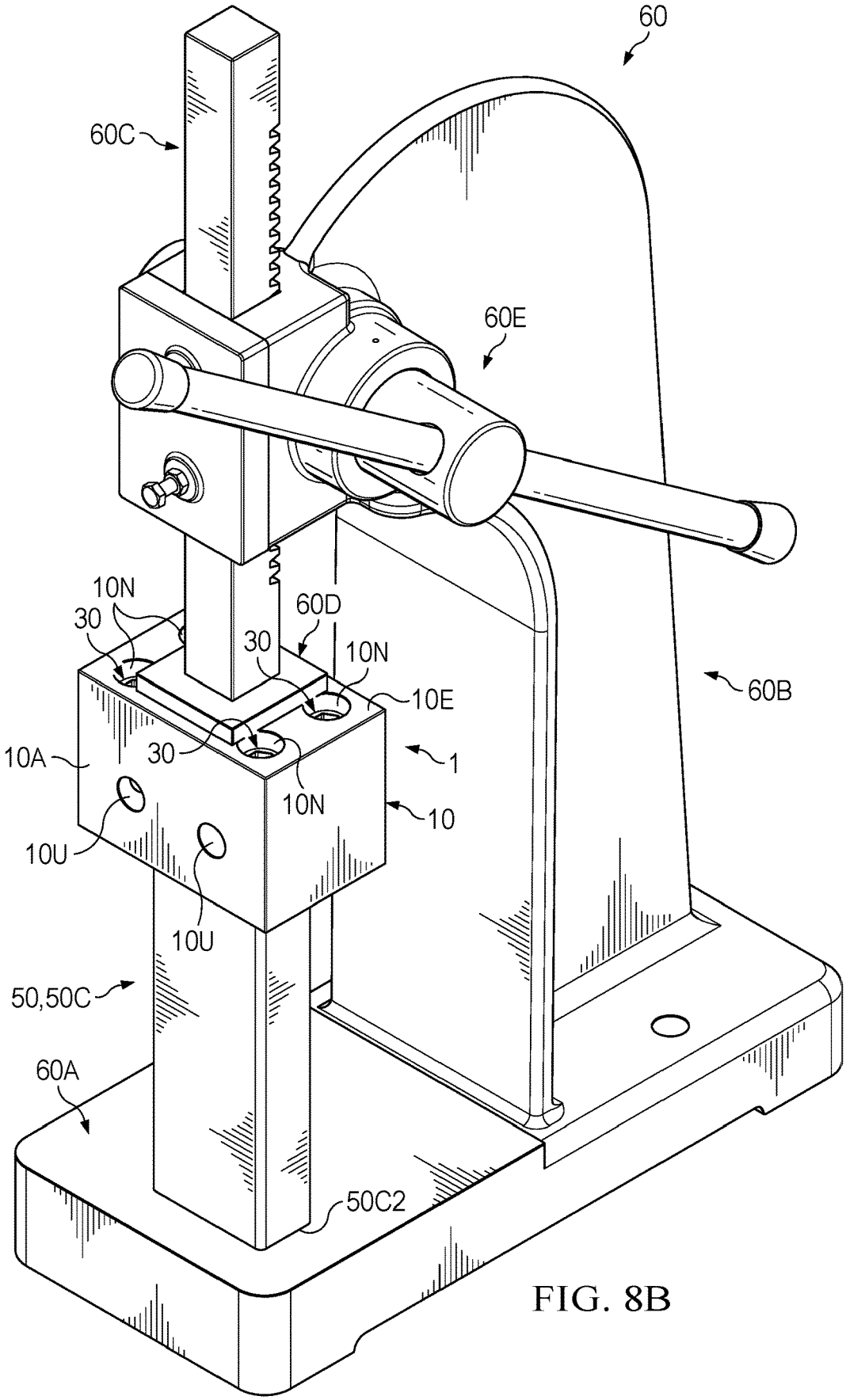
FIG. 8B (FIG. 8B) is an operational view of a countermeasure expendable and the crimping tool operably engaged with one another and being secured with an external pressing tool.

Once the cap 50A, the spacer 50B, and the cartridge case 50C are loaded into the main body 10, the user may then collectively introduce the crimping tool 1 and the countermeasure expendable 50 to an external pressing tool 60 (see FIG. 8B). In the present disclosure, external pressing tool 60 is an arbor press or tool that assists in applying external pressing force against the crimping tool 1 and the countermeasure expendable 50 to press-fit and crimp the cap 50A, the spacer 50B, and the cartridge case 50C with one another. As best seen in FIG. 8B, the cartridge case 50C rests on a base 60A of the external pressing tool 60 when the crimping tool 1 and the countermeasure expendable 50 are introduced to the external pressing tool 60. External pressing tool 60 also includes a support arm 60B that extends upwardly from the base 60A to hold a ram 60C, a plate 60D that engages with ram 60C, and a lever assembly 60E to vertically move the ram 60C and the plate 60D relative to the base 60A. The plate 60D of external pressing tool 60 then contacts and engages with the crimping tool 1 to hold the crimping tool 1 and the countermeasure expendable 50 in place on the base 60A. In particular, plate 60D of external pressing tool 60 contacts and engages with the top end 10E of main body 10 of crimping tool 1 to hold the crimping tool 1 and the countermeasure expendable 50 in place on the base 60A.

Figure 8C:
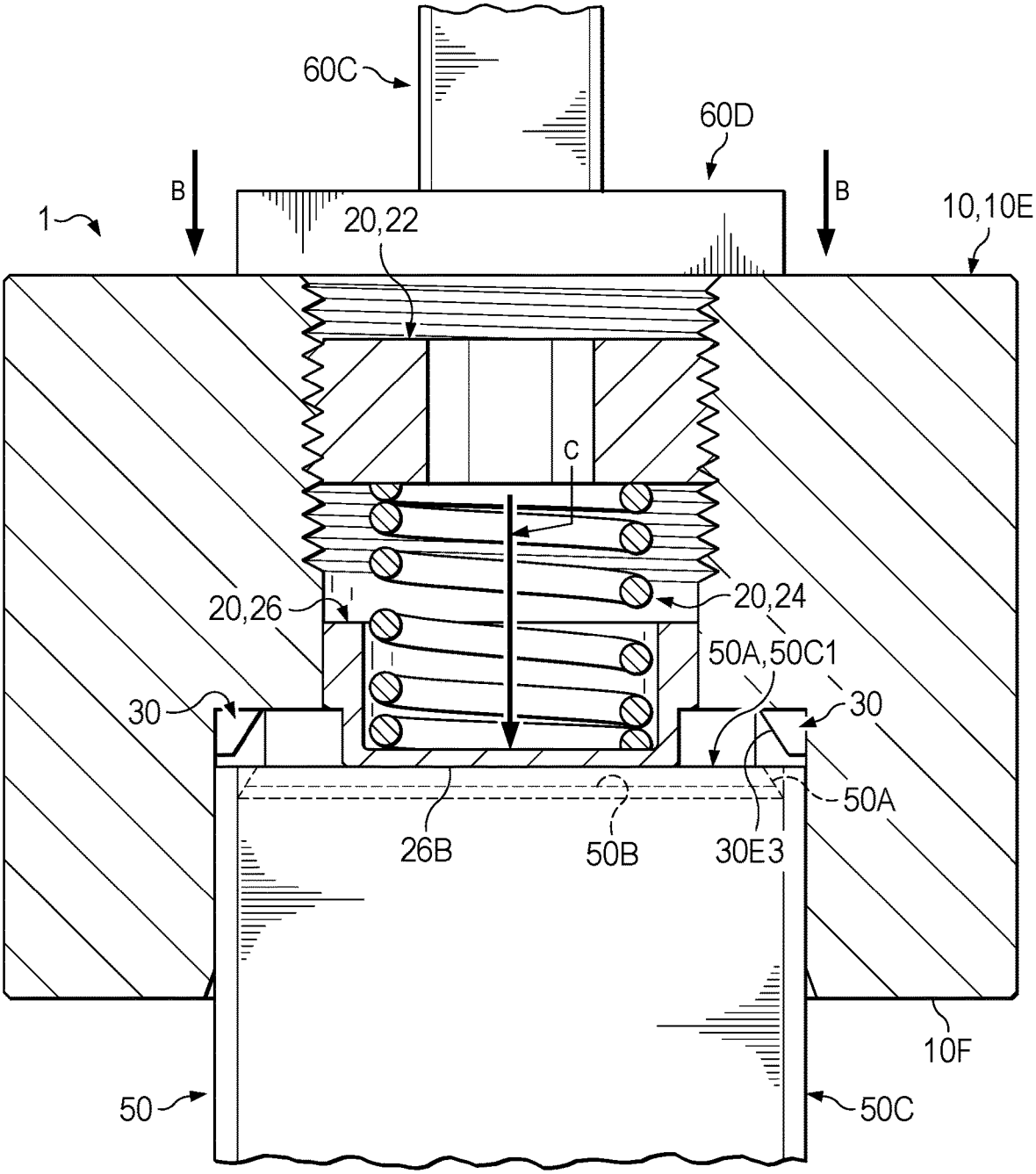
FIG. 8C (FIG. 8C) is another operational view similar to FIG. 8A, but a ram of the external pressing tool presses downwardly onto the crimping tool causing a stop of a presser of the crimping tool to press downwardly on the cap and the spacer of the countermeasure expendable.
Figure 8D:
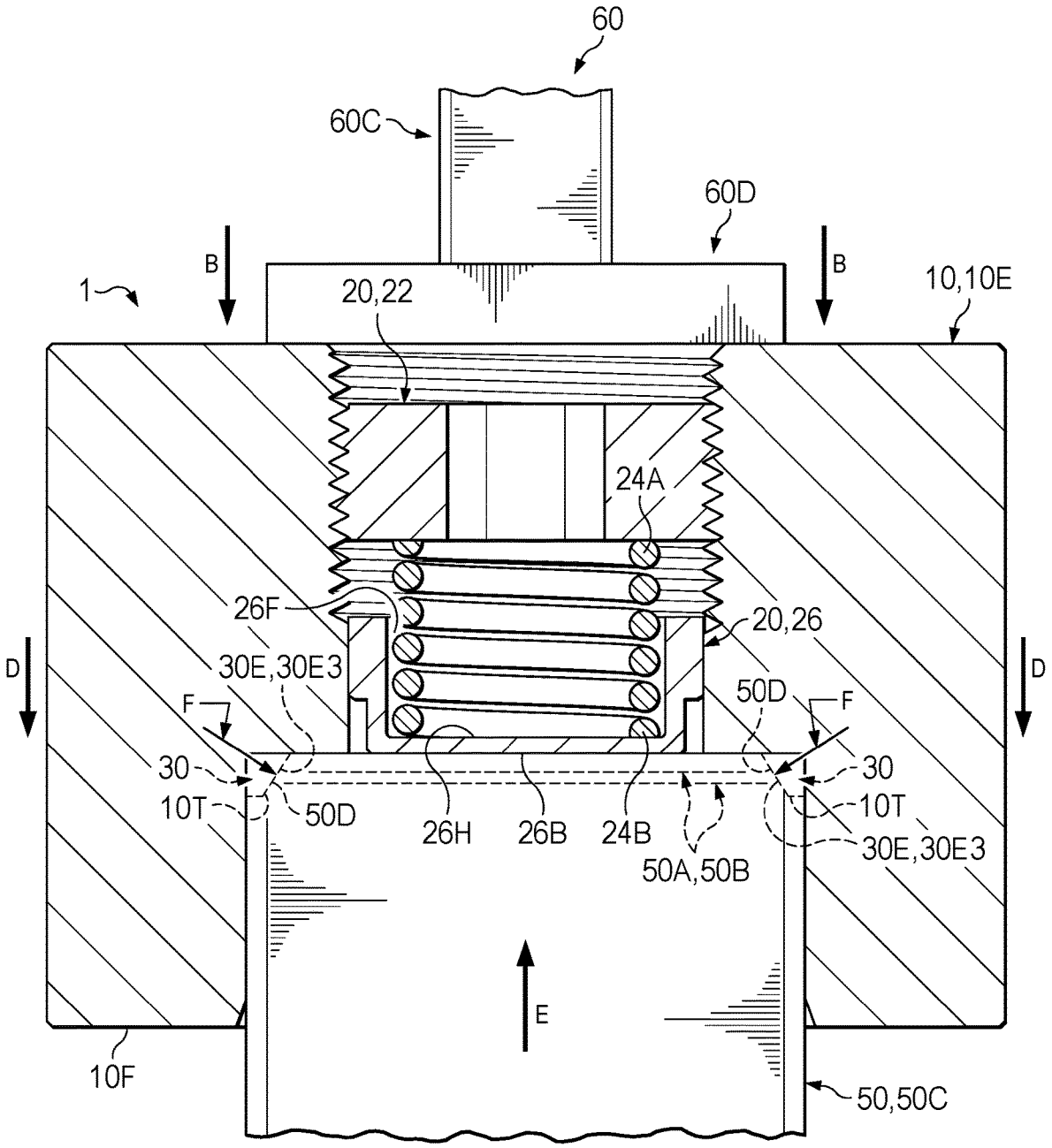
FIG. 8D (FIG. 8D) is another operational view similar to FIG. 8C, but the main body and the set of crimpers of the crimping tool move vertically downward as a stop of the presser press-fits the cap and the spacer of the countermeasure expendable with the cartridge case of the countermeasure expendable and the set of crimpers crimped with the cap, the spacer, and the cartridge case with one another.
Figure 8E:
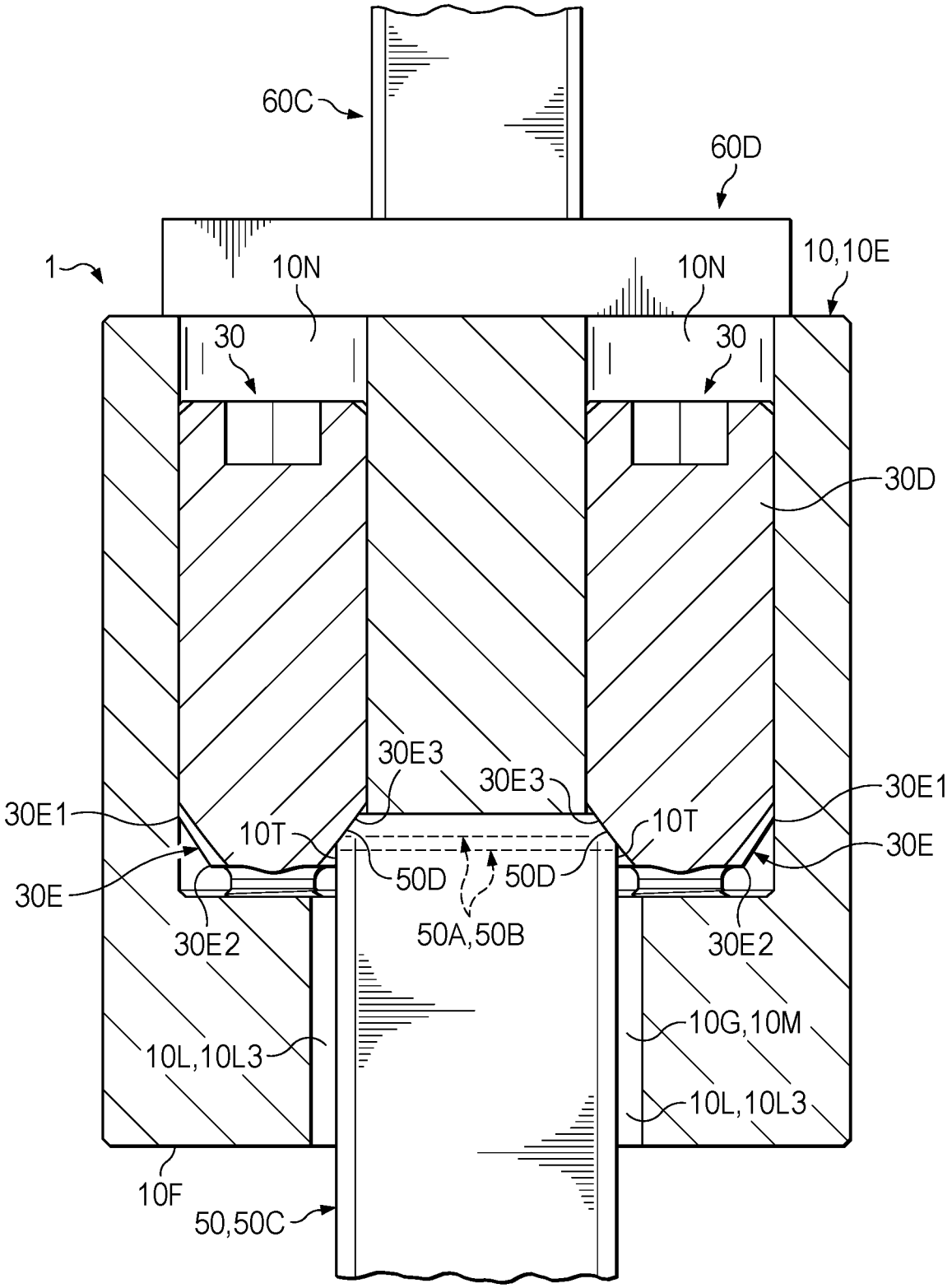
FIG. 8E (FIG. 8E) is another operational view similar to FIG. 8D where the main body and the set of crimpers of the crimping tool move vertically downward as a stop of the presser press-fits the cap and the spacer of the countermeasure expendable with the cartridge case of the countermeasure expendable and the set of crimpers crimped with the cap, the spacer, and the cartridge case with one another.

Once the crimping tool 1 and countermeasure expendable 50 are engaged with the external pressing tool 60, the user may then actuate the lever assembly 60E to begin the operations of press-fitting and crimping of the countermeasure expendable 50 by the crimping tool 1. As best seen in FIG. 8C, the ram 60C begins to apply a downward pressing force on the main body 10 of crimping tool 1, particularly at the top end 10E of main body 10, to begin the press-fit operation; such pressing force applied by the ram 60C of the external pressing tool 60 is denoted by arrows labeled "B" in FIG. 8C. As the user actuates the lever assembly 60E of external pressing tool 60 to apply the downward pressing force on the main body 10, such downward pressing force is sent downwardly through the main body to enable the stop 26 of presser 20 to apply the same downward pressing force on the cap 50A and the spacer 50B; such pressing force applied by the stop 26 of presser 20 is denoted by arrows labeled "C" in FIG. 8C. The stop 26 may remain engage at the first position and engaged with the shoulder 10J and shelf 10L1 until the cap 50A and the spacer 50B are press-fitted into the cartridge case 50C.

Once the cap 50A and the spacer 50B are press-fitted into the cartridge case 50C, the biaser 24 may transition from the expanded position to the compressed position causing the main body 10, the base 22, and the set of crimpers 30 to move downwardly while the stop 26 remains at the same engagement position. Such translation of the main body 10, the base 22, and the set of crimpers 30 as the biaser 24 transitions from the expanded position to the compressed position is denoted by arrows labeled "D" in FIG. 8D. As best seen in FIG. 8D, the biaser 24 only transitions from the expanded position to the compressed position when the force being applied by the countermeasure expendable 50 is greater than the biasing force of the biaser 24 once the cap 50A and the spacer 50B are press-fitted with and inside of the cartridge case 50C. Such force applied against the biaser 24 by the countermeasure expendable 50 is denoted by an arrow labeled "E" in FIG. 8D once the cap 50A and the spacer 50B are press-fitted with and inside of the cartridge case 50C. It should be noted that the force applied by the countermeasure expendable 50 occurs by the pressing and/or clamping force exerted by the external pressing tool 60 between the base 60A and the plate 60D.

As the cap 50A and the spacer 50B are press-fitted into the cartridge case 50C, each crimper of the set of crimpers 30 also applies a crimping force on each of the cap 50A, the spacer 50B, and the cartridge case 50C simultaneously or concurrently. As best seen in FIG. 8D, the crimping portion 30E of each crimper of the set of crimpers 30 applies an inward force against the cap 50A, the spacer 50B, and the cartridge case 50C to crimp the cap 50A, the spacer 50B, and the cartridge case 50C with one another; such inward force applied by each crimper of the set of crimpers 30 to crimp the cap 50A, the spacer 50B, and the cartridge case 50C with one another is denoted by arrows labeled "F" in FIG. 8D. Based on the present disclosure, cap 50A, spacer 50B, and the cartridge case 50C are crimped by the set of crimpers 30 at four crimping points or locations 50D (see FIGS. 8D-8F). The cap 50A, spacer 50B, and the cartridge case 50C are also crimped at the angle 30E4 of the angled wall 30E3 of each crimper of the set of crimpers 30. It should be understood that the cap 50A, spacer 50B, and the cartridge case 50C are press-fitted and crimped with one another at a desired tensile strength to prevent the cap 50A and spacer 50B from disengaging from the cartridge case 50C when in movement with a military platform or vehicle while still being able to disengage and/or separate from the cartridge case 50C upon a denotation force applied by an on-board squib or similar detonation device.

Figure 8F:
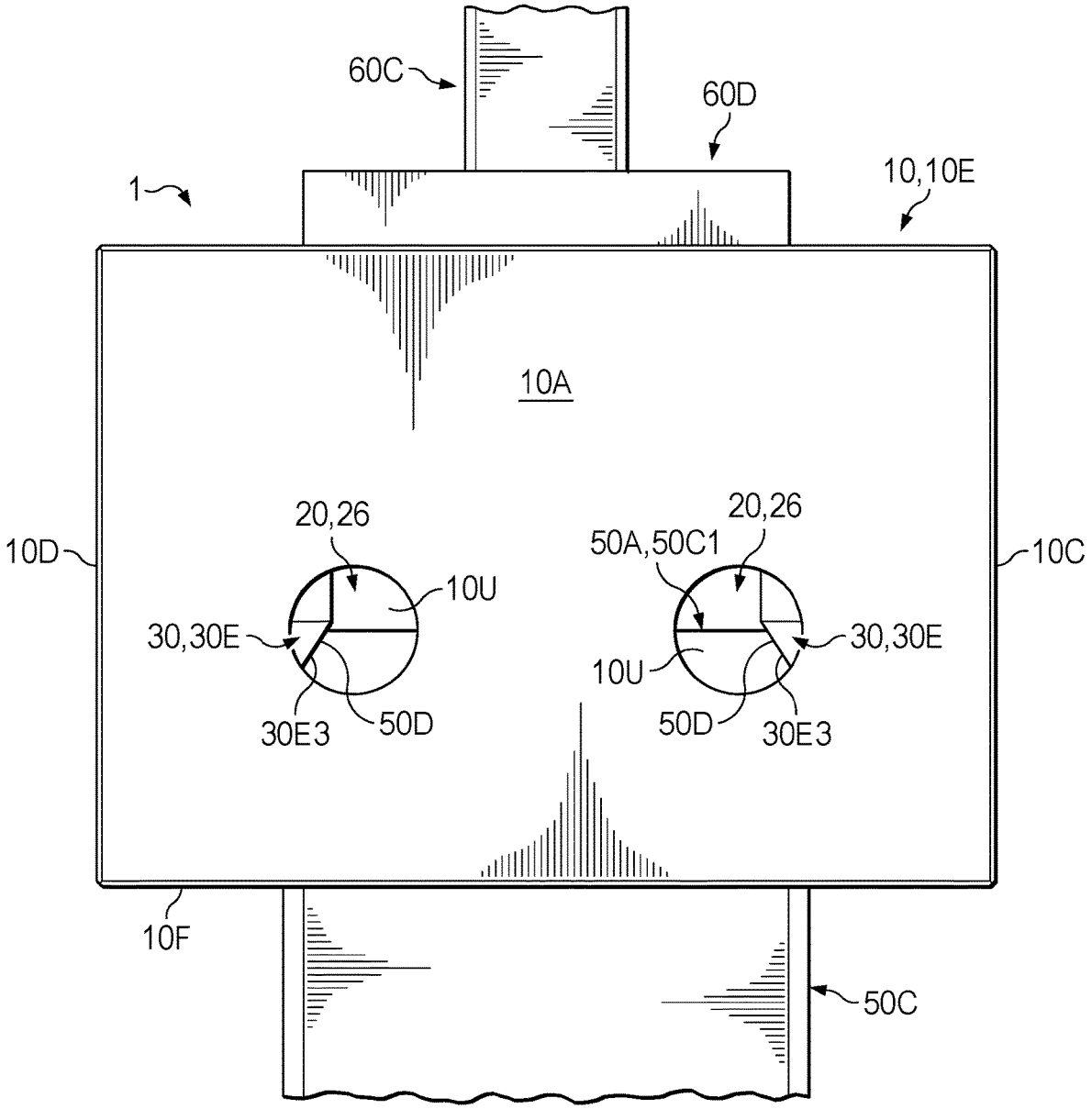
FIG. 8F (FIG. 8F) is another operational view similar to FIG. 8D where the countermeasure expendable is viewed from viewing apertures of the main body as the cap and the spacer of the countermeasure expendable are engaged and crimped with the cartridge case of the countermeasure expendable.

Once the cap 50A, the spacer 50B, and the cartridge case 50C are crimped with one another, the user may then check and/or determine that the countermeasure expendable 50 is assembled while still being housed inside of the crimping tool 1 and engaged with the external pressing tool 60. As best seen in FIG. 8F, the user may look through the set of viewing apertures 10U defined in front end 10A of the main body 10 to determine that the countermeasure expendable 50 is assembled (i.e., the cap 50A and the spacer 50B are press-fitted into the cartridge case 50C and the cap 50A, the spacer 50B, and the cartridge case 50C are crimped with one another) while still being housed inside of the crimping tool 1 and engaged with the external pressing tool 60. The user may look through the set of viewing apertures 10U of the main body 10 for one or more instance during an assembling operation of the countermeasure expendable 50 to ensure that the cap 50A and the spacer 50B are aligned with the cartridge case 50C prior to being press-fitted with the cartridge case 50C, to ensure that the cap 50A and the spacer 50B are aligned with the cartridge case 50C as the cap 50A and the spacer 50B are press-fitted with the cartridge case 50C, and/or to ensure that the cap 50A, the spacer 50B, and the cartridge case 50C are crimped with one another.

Figure 8G:
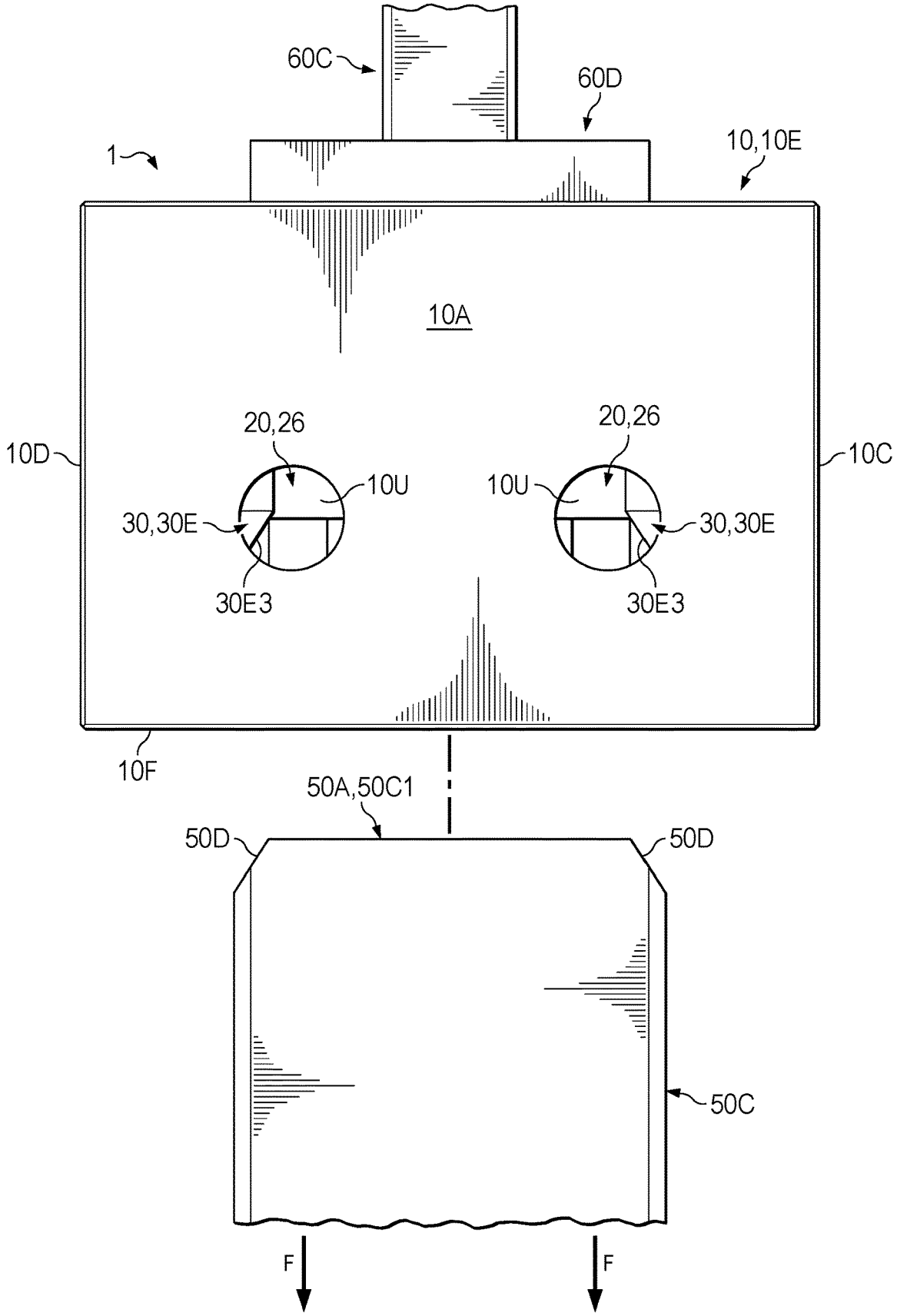
FIG. 8G (FIG. 8G) is another operational view similar to FIG. 8F, but the countermeasure expendable is removed from the crimping tool upon completion of crimping operations.
Figure 8H:
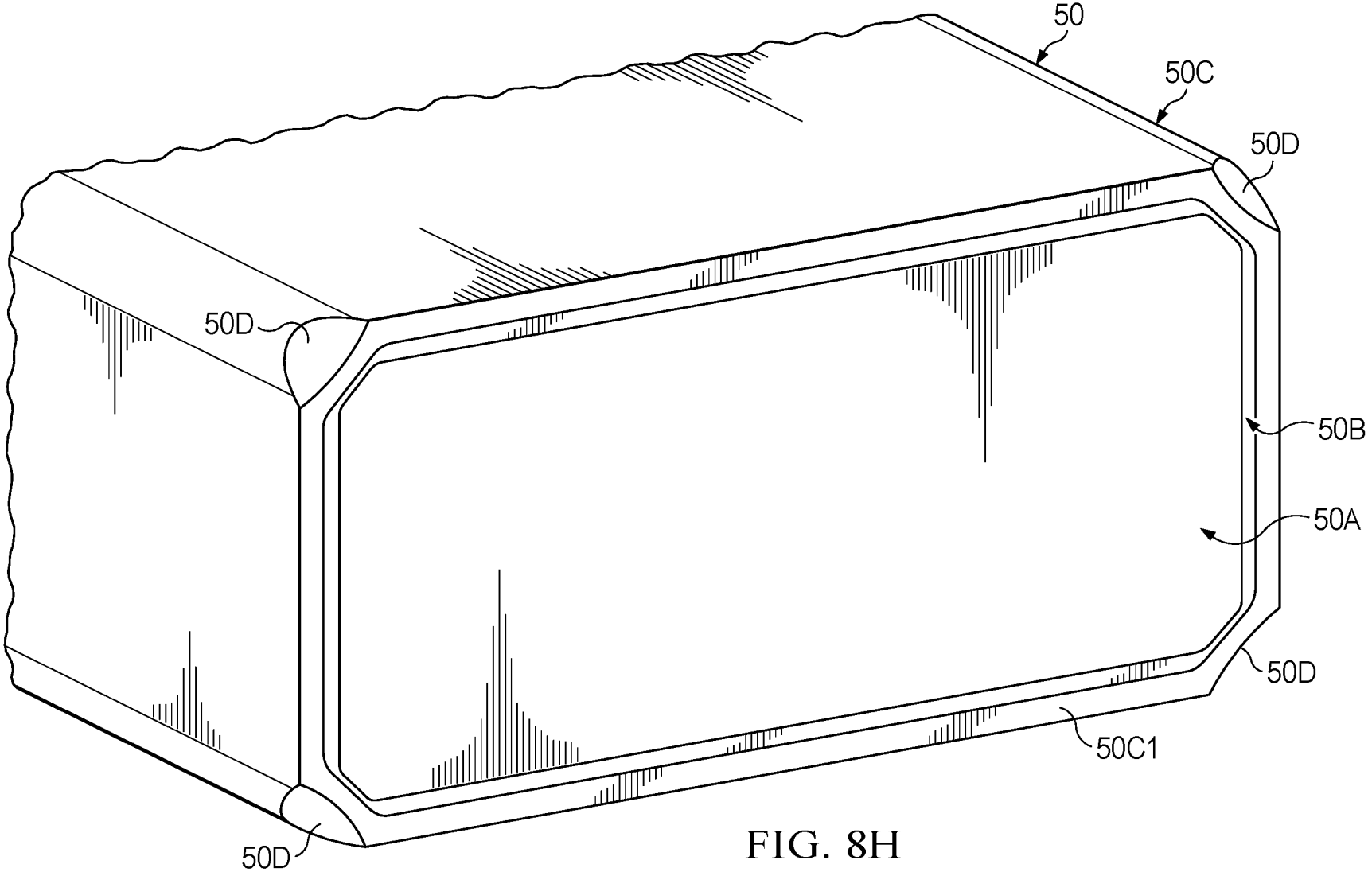
FIG. 8H (FIG. 8H) is a partial front, top, side elevation view of the countermeasure expandable having crimped corners.

Once crimped, the user may then remove the countermeasure expendable 50 from the crimping tool 1 (see arrows labeled "F" in FIG. 8G). Once removed, the countermeasure expandable 50 includes crimps 50D at each corner such that the cap 50A, the spacer 50B, and the cartridge case 50C are assembled with one another. Upon assembly, the spacer 50B is crimped between the cap 50A and the cartridge case 50B to prevent unwanted vibration and/or movement of internal parts and components of the countermeasure expendable during use.

Figure 9:
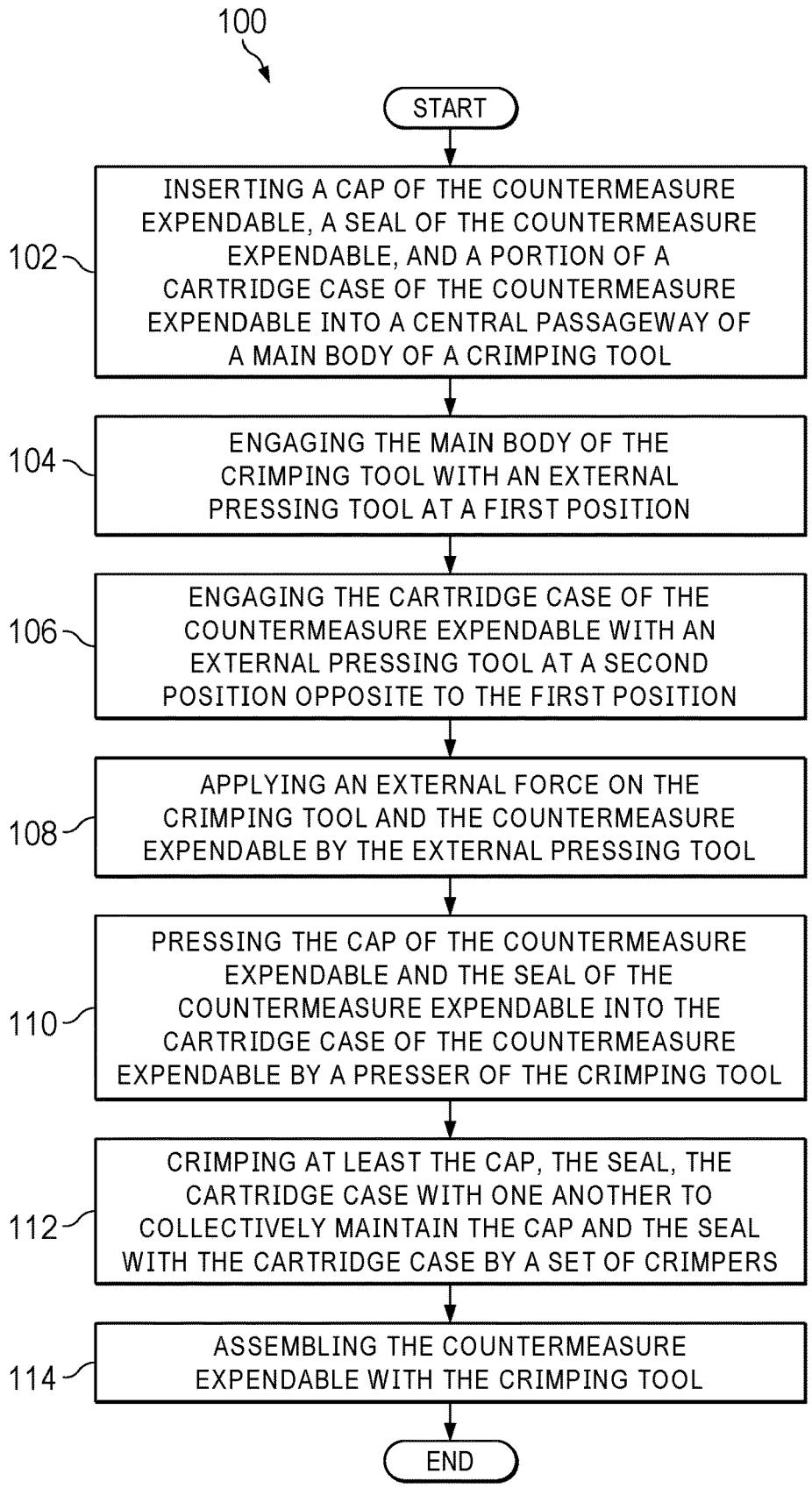
FIG. 9 (FIG. 9) is an exemplary method flowchart of assembling a countermeasure expendable with a cartridge tool.

FIG. 9 illustrates a method 100 of assembling a countermeasure expendable with a crimping tool. An initial step 102 of method 100 includes inserting a cap of the countermeasure expendable, a spacer of the countermeasure expendable, and a portion of a cartridge case of the countermeasure expendable into a central passageway of a main body of a crimping tool. Another step 104 of method 100 includes engaging the main body of the crimping tool with an external pressing tool at a first position. Another step 106 of method 100 includes engaging the cartridge case of the countermeasure expendable with an external pressing tool at a second position opposite to the first position. Another step 108 of method 100 includes applying an external force on the crimping tool and the countermeasure expendable by the external pressing tool. Another step 110 of method 100 includes pressing the cap of the countermeasure expendable and the spacer of the countermeasure expendable into the cartridge case of the countermeasure expendable by a presser of the crimping tool. Another step 112 of method 100 includes crimping at least the cap, the spacer, the cartridge case with one another to collectively maintain the cap and the spacer with the cartridge case by a set of crimpers. Another step 114 of method 100 includes assembling the countermeasure expendable with the crimping tool.

In other exemplary embodiments, additional or optional steps may further be included with method 100 in assembling a countermeasure expendable with a crimping tool. An optional step may further include determining the at least the cap, the spacer, the cartridge case are crimped with one another, by at least one viewing aperture defined in the main body, when the cap, the spacer, the cartridge case are provided inside of the main body. Another optional step may further include adjusting a base of the presser to a desired height inside of the central passageway of the main body; wherein the base is adjusted along an axis defined between a top end of the main body and a bottom end of the main body. An optional step may further include exerting biasing forces on a stop of the presser and the base of the presser in opposing direction by a biaser of the presser. An optional step may further include pressing the stop of the presser against one or both of a shoulder of the main body and a shelf of the main body inside of the central passageway. Optional steps may further include compressing the biaser of the presser from an expanded position to a compressed position by the external pressing tool; disengaging the stop of the presser from one or both of the shoulder of the main body and the shelf of the main body inside of the central passageway; and moving the stop of the presser along the axis of the main body defined between the top end of the main body and the bottom end of the main body when the cap of the countermeasure expendable and the spacer of the countermeasure expendable are pressed into the cartridge case of the countermeasure expendable. An optional step may further include engaging the set of crimpers with the main body inside a set of outer passageways; and wherein the set of outer passageways is in fluid communication with the central passageway.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A crimping tool for a countermeasure expendable, the crimping tool comprising:

a main body having a top end, a bottom end vertically opposite to the top end, and an axis defined between the top end and the bottom end, wherein the main body is configured to receive a cap of the countermeasure expendable, a spacer of the countermeasure expendable, and a portion of a cartridge case of the countermeasure expendable between the top end and the bottom end;

a presser selectively operably engaged with the main body and configured to press the cap and the spacer of the countermeasure expendable into the cartridge case of the countermeasure expendable; and a set of crimpers operably engaged with the main body and configured to crimp at least the cap, the spacer, and the cartridge case with one another to collectively maintain the cap and the spacer with the cartridge case;

wherein the main body comprises:

a central passageway defined between the top end of the main body and the bottom end of the main body; and a set of outer passageways defined between the top end of the main body and the bottom end of the main body;

wherein the presser is selectively operably engaged with the main body at the central passageway and the cap of the countermeasure expendable, the spacer of the countermeasure expendable, and the portion of the cartridge case of the countermeasure expendable is housed in the central passageway;

wherein each crimper of the set of crimpers is operably engaged with the main body inside a respective outer passageway of the set of outer passageways;

wherein each crimper of the set of crimpers comprises:

a first end, a second end opposite to the first end, and a longitudinal axis defined therebetween;

a blanked portion extending from the first end towards the second end;

a crimping portion extending from the blanked portion towards the second end and in open communication with the central passageway; and a threaded portion extending from the crimping portion to the second end.

2. The crimping tool of claim 1, wherein the presser comprises:

a base selectively operably engaged with the main body;

a stop moveably engaged with the main body and spaced apart from the base; and a biaser operably engaged with the base and the stop and configured to bias the stop away from the base.

3. The crimping tool of claim 2, wherein the main body comprises:

a first interior wall extending from the top end of the main body and towards the bottom end wherein the main body comprises and defining an upper central passage;

wherein the base of the presser is configured to selectively operably engage with the first interior wall.

4. The crimping tool of claim 3, wherein the main body further comprises:

a shoulder extending outwardly from the first interior wall and into the upper central passage;

wherein a first portion of the stop is configured to rest on the shoulder of the main body.

5. The crimping tool of claim 4, wherein the main body further comprises:

a second interior wall extending from the shoulder to the bottom end of the main body and defining a lower central passage that is in open communication with the upper central passage;

wherein the main body is configured to receive and house the cap of the countermeasure expendable, the spacer of the countermeasure expendable, and the portion of the cartridge case of the countermeasure expendable inside of the lower central passage.

6. The crimping tool of claim 5, wherein the main body further comprises:

a shelf extending inwardly into the second interior wall and positioned below the shoulder;

wherein a second portion of the stop is configured to rest on the shelf of the main body.

7. The crimping tool of claim 1, wherein each crimper of the set of crimpers further comprises:

a first end of the crimping portion positioned proximate to the blanked portion;

a second end of the crimping portion positioned proximate to the threaded portion and opposite to the first end; and a wall extending between the first end and the second end;

wherein at least the wall is configured to crimp at least the cap, the spacer, the cartridge case with one another to collectively maintain the cap and the spacer with the cartridge case.

8. The crimping tool of claim 7, wherein each crimper of the set of crimpers further comprises:

an angle defining the wall measured relative to the longitudinal axis;

wherein the angle is an acute angle.

9. The crimping tool of claim 1, wherein the main body further comprises:

a set of first inner walls wherein each first inner wall of the set of first inner walls extends from the top end of the main body to a respective first base wall of a set of first base walls that is positioned between the top end of the main body and the bottom end of the main body; and a set of second inner walls wherein each second inner wall of the set of second inner walls extends from a respective first base wall of the set of first base walls to the bottom end of the main body;

wherein each first inner wall of the set of first inner walls and each first base wall of the set of first base walls defines a first portion of a respective outer passageway of the set of outer passageways;

wherein each second inner wall of the set of second inner walls defines a second portion of a respective outer passageway of the set of outer passageways.

10. The crimping tool of claim 9, wherein the main body further comprises:

a through-hole defined in a first inner wall of the set of first inner walls and in a first base wall of the set of first base walls of each outer passageway of the set of outer passageways;

wherein the crimping portion of a respective crimper of the set of crimpers is positioned inside of the through-hole and in fluid communication with the central passageway.

11. The crimping tool of claim 1, wherein the main body further comprises:

at least one viewing aperture defined in a front end of the main body that is positioned between the top end and the bottom end;

wherein the at least one viewing aperture is in open communication with the central passageway and at least one outer passageway of the set of outer passageways.

12. A method of assembling a countermeasure expendable with a crimping tool, comprising:

inserting a cap of the countermeasure expendable, a spacer of the countermeasure expendable, and a portion of a cartridge case of the countermeasure expendable into a central passageway of a main body of a crimping tool;

pressing the cap of the countermeasure expendable and the spacer of the countermeasure expendable into the cartridge case of the countermeasure expendable by a presser of the crimping tool;

crimping at least the cap, the spacer, the cartridge case with one another to collectively maintain the cap and the spacer with the cartridge case by a set of crimpers;

assembling the countermeasure expendable with the crimping tool; and determining the at least the cap, the spacer, the cartridge case are crimped with one another, by at least one viewing aperture defined in the main body, when the cap, the spacer, the cartridge case are provided inside of the main body.

13. The method of claim 12, further comprising:

engaging the main body of the crimping tool with an external pressing tool at a first position;

engaging the cartridge case of the countermeasure expendable with the external pressing tool at a second position opposite to the first position; and applying an external force on the crimping tool and the countermeasure expendable by the external pressing tool.

14. The method of claim 12, further comprising:

adjusting a base of the presser to a desired height inside of the central passageway of the main body;

wherein the base is adjusted along an axis defined between a top end of the main body and a bottom end of the main body.

15. The method of claim 13, further comprising:

exerting biasing forces on a stop of the presser and the base of the presser in opposing direction by a biaser of the presser; and pressing the stop of the presser against one or both of a shoulder of the main body and a shelf of the main body inside of the central passageway.

16. The method of claim 15, further comprising:

compressing the biaser of the presser from an expanded position to a compressed position by the external pressing tool;

disengaging the stop of the presser from one or both of the shoulder of the main body and the shelf of the main body inside of the central passageway; and moving the stop of the presser along the axis of the main body defined between the top end of the main body and the bottom end of the main body when the cap of the countermeasure expendable and the spacer of the countermeasure expendable are pressed into the cartridge case of the countermeasure expendable.

17. A crimping tool for a countermeasure expendable, the crimping tool comprising:

a main body having a top end, a bottom end opposite to the top end, and an axis defined between the top end and the bottom end, wherein the main body is configured to receive a cap, a spacer, and a portion of a cartridge case;

a presser selectively operably engaged with the main body and configured to press the cap and the spacer of the countermeasure expendable into the cartridge case of the countermeasure expendable, the presser further comprising a base selectively operably engaged with the main body, a stop moveably engaged with the main body and spaced apart from the base, and a biaser operably engaged with the base and the stop and configured to bias the stop away from the base; and a set of crimpers operably engaged with the main body and configured to crimp at least the cap, the spacer, and the cartridge case with one another to collectively maintain the cap and the spacer with the cartridge case and to seal the countermeasure expendable;

wherein the main body comprises:

a central passageway defined between the top end of the main body and the bottom end of the main body; and a set of outer passageways defined between the top end of the main body and the bottom end of the main body;

wherein the presser is selectively operably engaged with the main body at the central passageway and the cap of the countermeasure expendable, the spacer of the countermeasure expendable, and the portion of the cartridge case of the countermeasure expendable is housed in the central passageway;

wherein each crimper of the set of crimpers is operably engaged with the main body inside a respective outer passageway of the set of outer passageways;

wherein each crimper of the set of crimpers comprises:

a first end, a second end opposite to the first end, and a longitudinal axis defined therebetween;

a blanked portion extending from the first end towards the second end;

a crimping portion extending from the blanked portion towards the second end and in open communication with the central passageway; and a threaded portion extending from the crimping portion to the second end.

* * * * *